US010184297B2

(12) United States Patent
Noui-Mehidi

(10) Patent No.: US 10,184,297 B2
(45) Date of Patent: Jan. 22, 2019

(54) DRILLING AND OPERATING SIGMOID-SHAPED WELLS

(71) Applicant: Saudi Arabian Oil Company, Dhahran (SA)

(72) Inventor: Mohamed N. Noui-Mehidi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 15/888,312

(22) Filed: Feb. 5, 2018

(65) Prior Publication Data

US 2018/0230751 A1 Aug. 16, 2018

Related U.S. Application Data

(60) Provisional application No. 62/458,078, filed on Feb. 13, 2017.

(51) Int. Cl.

| | |
|---|---|
| ***E21B 7/04*** | (2006.01) |
| ***E21B 7/06*** | (2006.01) |
| ***E21B 33/068*** | (2006.01) |
| ***E21B 6/04*** | (2006.01) |

(Continued)

(52) U.S. Cl.

CPC ..... *E21B 7/061* (2013.01); *E21B 6/04* (2013.01); *E21B 7/02* (2013.01); *E21B 7/046* (2013.01); *E21B 33/04* (2013.01); *E21B 33/068* (2013.01)

(58) Field of Classification Search

CPC combination set(s) only.
See application file for complete search history.

(56) References Cited

U.S. PATENT DOCUMENTS 3,486,571 A 12/1969 Silverman
3,708,024 A * 1/1973 Back ..... E21B 7/02 173/147
4,995,465 A 2/1991 Beck et al.
(Continued)

FOREIGN PATENT DOCUMENTS

SU 1231149 5/1986
WO 2014201237 A1 12/2014

OTHER PUBLICATIONS

International Search Report and Written Opinion for International Application No. PCT/US2018/017735; International Filing Date Feb. 12, 2018; Report dated May 15, 2018 (pp. 1-13).
(Continued)

*Primary Examiner* — D. Andrews
*Assistant Examiner* — Ronald R Runyan
(74) *Attorney, Agent, or Firm* — Bracewell LLP; Constance G. Rhebergen; Christpher L. Drymalla

(57) ABSTRACT

Provided are systems and methods for drilling a horizontally-oriented well having a sigmoid-shaped wellbore including an upper sigmoid portion having a downward curving wellbore trajectory and a lower sigmoid portion having an upward curving wellbore trajectory. The upper sigmoid portion having a first trajectory having a generally horizontal gradient at an entry point of the wellbore and that increases in downward gradient to a vertical gradient at an inflection point. The lower sigmoid portion having a second trajectory that includes the vertical gradient at the inflection point and that decreases in downward gradient to a generally horizontal gradient at a horizontal transition point of the wellbore.

28 Claims, 9 Drawing Sheets

(51) Int. Cl.
*E21B 7/02* (2006.01)
*E21B 33/04* (2006.01)

(56) References Cited

U.S. PATENT DOCUMENTS

| | | | | |
|---|---|---|---|---|
| 5,133,418 | A | 7/1992 | Gibson et al. | |
| 6,389,360 | B1 | 5/2002 | Alft et al. | |
| 6,757,613 | B2 | 6/2004 | Chapman et al. | |
| 7,287,337 | B2 | 10/2007 | Dimitroff | |
| 7,528,946 | B2 | 5/2009 | Gunsaulis | |
| 8,672,055 | B2 | 3/2014 | Boone et al. | |
| 8,833,183 | B2 | 9/2014 | Blessum et al. | |
| 8,862,436 | B2 | 10/2014 | Samuel | |
| 8,892,407 | B2 | 11/2014 | Budiman et al. | |
| 2001/0052426 | A1 * | 12/2001 | Mercer | E21B 7/046 175/26 |
| 2008/0121399 | A1 | 5/2008 | Zupanick | |
| 2012/0234551 | A1 | 9/2012 | Keller et al. | |
| 2015/0234081 | A1 | 8/2015 | Maus et al. | |
| 2015/0322753 | A1 | 11/2015 | Zimmerman, Jr. | |

OTHER PUBLICATIONS

Menand, S., et al.; "How the Bit Profile and Gages Affect the Well Trajectory" IADC/SPE 74459, IADC/SPE Drilling Conference Feb. 26-28, 2002; pp. 1-13.

* cited by examiner

DRILLING AND OPERATING SIGMOID-SHAPED WELLS

FIELD

Embodiments relate generally to drilling wells, and more particularly to drilling wells having non-traditional well trajectories.

BACKGROUND

A well can include a borehole (or "wellbore") that is drilled into the earth. A well can provide access to a subsurface formation (a geographic formation below the earth's surface) to facilitate the extraction of natural resources, such as hydrocarbons and water from the subsurface formation, to facilitate the injection of fluids into the subsurface formation, and to facilitate the evaluation and monitoring of the subsurface formation. In the petroleum industry, wells are often drilled to extract (or "produce") hydrocarbons, such as oil and gas, from subsurface formations. The term "oil well" is often used to describe a well designed to produce oil. In the case of an oil well, some natural gas is typically produced along with oil. Wells producing both oil and natural gas are sometimes referred to as "oil and gas wells" or "oil wells." The term "gas well" is normally reserved to describe a well designed to produce primarily natural gas.

Creating an oil well typically involves several stages, including a drilling stage, a completion stage and a production stage. The drilling stage typically involves drilling a wellbore into a subsurface formation that is expected to contain a concentration of hydrocarbons that can be produced. The portion of the formation expected to contain hydrocarbons is often referred to as a "hydrocarbon reservoir" or a "reservoir." The drilling process is often facilitated by a vertical drilling rig that sits at the earth's surface. The drilling rig provides for operating the drill bit; hoisting, lowering and turning drill pipe and tools; circulating drilling fluids; and generally controlling down-hole operations (operations in the wellbore). The completion stage involves making the well ready to produce hydrocarbons. In some instances, the completion stage includes pumping fluids into the well to fracture, clean or otherwise prepare the reservoir to produce the hydrocarbons. The production stage involves producing (extracting and capturing) hydrocarbons from the reservoir by way of the well. During the production stage, the drilling rig is normally removed and replaced with a collection of valves, often referred to as a "production tree" or a "Christmas tree", that regulates pressure in the wellbore, controls production flow from the wellbore, and provides access to the wellbore in the case further completion work is needed. A pump jack or other mechanism can provide lift that assists in extracting hydrocarbons from the reservoir, especially in instances where the pressure in the well is so low that the hydrocarbons do not flow freely to the surface. Flow from an outlet valve of the production tree is often coupled to a distribution network, such as tanks, pipelines and transport vehicles that supply the production to refineries, export terminals, and so forth.

A well traditionally includes a generally vertical wellbore that extends downward into the earth, in a direction that is generally perpendicular to the earth's surface. Such a well is often referred to as a "vertical well". The term "horizontal well" is often used to describe a well having a wellbore section that extends in a generally horizontal direction. A horizontal well often includes a generally vertical or deviated wellbore having an upper-vertical wellbore portion that extends downward into the earth in a direction that is generally perpendicular to the earth's surface, and a lower-horizontal wellbore portion that extends in a generally horizontal direction through the earth, often following a profile of a reservoir. In either case, a vertical drilling rig is normally positioned at the earth's surface, above the location of the wellbore, and provides for lowering and raising drill pipe, tools, and the like vertically, into and out of the wellbore.

SUMMARY

Applicants have recognized that, although vertically-oriented wells (for example, including vertical and horizontal wells having wellbores with at least an upper-vertical wellbore portion that extends downward from the earth's surface in a direction that is generally perpendicular to the earth's surface) provide a suitable means for producing hydrocarbons in many instances, these vertically-oriented wells have shortcomings. For example, during the drilling process it is often necessary to provide a motive force that pushes the drill bit to assist in drilling the wellbore. In the case of vertically-oriented wells, this motive force is typically provided by the weight of a drill string, including drill pipe that extends into the wellbore. As the drill string is rotated, its weight provides a downward force on the rotating drill bit to help the drill bit cut through the earth. In many instances, it is desirable to have a relatively high motive force acting on the drill bit; unfortunately, the weight of the drill string is limited when drilling vertically-oriented wells and, thus, the speed and efficiency of drilling vertically-oriented wells can be limited.

Applicants have also recognized that vertically-oriented wells can have geographic limitations. For example, in many instances vertically-oriented horizontal wells are used to drill under or near a target location from an extended distance away. In many cases the drilling rig and the upper-vertical wellbore portion of the well are located in first location, and the lower-horizontal portion of the wellbore extends some distance horizontally through the earth, to a location near or under the target location. If there are limitations on well locations, such as a requirement that wells be at least a given distance from a populated area, the horizontal portion of the well may need to be relatively long to reach the target from the location of the drilling rig. Unfortunately, the limitations of vertically-oriented wells, such as the limited motive force that can be provided, can inherently limit the length of the horizontal portion of the wellbore. As a result, a vertically-oriented horizontal well may not be able to extend the distance needed to reach its target, and reservoirs known to contain hydrocarbons may not be produced based on the inability to reach the reservoir with traditional vertically-oriented wells.

Further, Applicants have recognized that a significant amount of energy is expended to lift fluids to the surface from the wellbore. This can be attributed to the force necessary to overcome hydrostatic pressure from deep in the wellbore to bring the trapped hydrocarbons up to the surface. During production, if the reservoir fluids exhibit a relatively low pressure, the pressure may not be sufficient to raise the fluids to the surface. As a result, artificial lift methods may be needed to help lift the fluids to the surface. This can include adding a lifting device, such as a pumping jack, or employing enhanced oil recovery techniques (EOR), such as drilling additional nearby injection wells that can be used to inject fluids into the reservoir to increase reservoir pressure in an effort to force the production fluids into the wellbore and up to the surface. Unfortunately, these solutions can require significant amounts of time and increase overall production cost.

Recognizing these and other shortcomings of existing vertically-oriented wells, Applicants have developed novel systems and methods for drilling horizontally-oriented wells. In some embodiments, a horizontally-oriented well includes a sigmoid-shaped (or "S-shaped") horizontally-oriented wellbore. The sigmoid-shaped wellbore may include a sigmoid portion and a horizontal portion. The sigmoid portion may include a first (or "upper") sigmoid portion and a second (or "lower") sigmoid portion. The first sigmoid portion may have a downward curving wellbore trajectory (of gradually increasing slope relative to a horizontal plane), and the second sigmoid portion may have an upward curving wellbore trajectory (of gradually decreasing slope relative to the horizontal plane) that terminates into the horizontal portion of the wellbore. The horizontal portion of the wellbore may extend in a generally horizontal trajectory, for example, following a profile of a reservoir. The shape of the sigmoid portion of the wellbore can provide a vertical path through the formation that begins in a generally horizontal orientation and gradually increases in slope to a more vertical orientation, and then gradually decreases in slope back to a generally horizontal orientation, where it meets the horizontal portion of the wellbore. As a result, the wellbore can enter the earth in a generally horizontal orientation and not have the steep-vertical slope traditionally associated with at least the upper substantially-vertical wellbore portion of a vertically-oriented well.

Advantageously, such a sigmoid-shaped wellbore can enable a relatively high, non-vertical motive force to be applied to the drill string. For example, a horizontally-oriented well drilling system can include a horizontal driver (for example, a vehicle or a ram) that pushes the drill string horizontally, providing a relatively high motive force on the drill bit to facilitate the drill bit cutting through the earth.

As another advantage, the relatively shallow slope of the trajectory of the sigmoid shaped wellbore can reduce the hydrostatic pressure needed to lift fluids to the surface by way of the horizontally-oriented sigmoid shaped wellbore, relative to the hydrostatic pressure needed to lift fluids to the surface by way of a vertically-oriented wellbore. For example, in vertically-oriented wells the hydrostatic pressure is due mainly to the accumulation of fluids in the vertical portion of the wellbore, and the forces needed to lift the fluid must be sufficient to overcome the vertically-oriented downward force gravity acting on the vertically-oriented fluid column. In the sigmoid shaped wellbore, however, the fluid column (or at least a large portion of the fluid column) is not oriented vertically (for example, being oriented somewhat inclined or nearly horizontally) such that the downward force of gravity acting on the fluid column does not directly align with the orientation of fluid column. As a result, the forces needed to lift the fluid in the non-vertical direction of the sigmoid shaped wellbore are relatively low in comparison to the forces needed to lift fluid in a vertically-oriented fluid column. As a result, the artificial lift requirements for a well having a sigmoid shaped wellbore can be eliminated or reduced in comparison with the artificial lift requirements for traditional wellbores containing substantially vertical sections.

Further, in a horizontally-oriented well, the drill string can enter the earth in a generally horizontal angle, such that a vertical rig is not required, reducing a height that the drilling system extends above the earth's surface. Also, the relatively low hydrostatic pressure needed to lift fluids to the surface by way of the wellbore can eliminate the need for pump-jacks (or at least larger and taller pump jacks) or other devices needed to create artificial lift. Thus, horizontally-oriented wells and the associated drilling and production systems can have a relatively low height profile when compared to the height profiles of vertically-oriented wells, and they can be a viable option in locations where height restrictions inhibit the use of traditional vertically-oriented drilling and production systems.

Provided in some embodiments is a method that includes the following: installing a wellhead system having a wellhead passage extending from a wellhead entry point in a vertically oriented side of a wellhead body of the wellhead system, to a wellhead exit point in a horizontally oriented underside of the wellhead body; and advancing a drill string through the wellhead passage to drill a horizontally-oriented hydrocarbon well having a sigmoid-shaped wellbore including an upper sigmoid portion having a downward curving wellbore trajectory and a lower sigmoid portion having an upward curving wellbore trajectory. The upper sigmoid portion having a first trajectory including a generally horizontal gradient at the wellhead exit point and that increases in downward gradient to a vertical gradient at an inflection point, and the lower sigmoid portion having a second trajectory that includes the vertical gradient at the inflection point and decreases in downward gradient to a generally horizontal gradient at a horizontal transition point of the wellbore.

Provided in some embodiments is a hydrocarbon well drilling system that includes a wellhead system including a wellhead body disposed at a surface of the earth. The wellhead body including a wellhead passage adapted to guide a drill string from a horizontal orientation to a downward sloping orientation of a wellbore having a sigmoid well trajectory. The wellhead passage extending from a wellhead entrance at a vertically oriented side of the wellhead body to a wellhead exit at a horizontally oriented underside of the wellhead body. The hydrocarbon well drilling system also including a drill string adapted to pass through the wellhead passage, and including a horizontally oriented starting end and a drill bit adapted to bore through a subsurface formation to create the wellbore having the sigmoid well trajectory. The wellbore including a first sigmoid portion extending from the wellhead exit to an inflection point of the wellbore. The inflection point being located downhole from the wellhead exit. The first sigmoid portion of the wellbore including a first trajectory that is generally horizontal at the wellhead exit of the wellbore and that increases in slope to a first gradient at the inflection point. The wellbore also including a second sigmoid portion extending from the inflection point of the wellbore to a transition point of the wellbore. The transition point being located downhole from the inflection point. The second sigmoid portion of the wellbore including a second trajectory that matches the first gradient of the first sigmoid portion of the wellbore at the inflection point and that decreases in slope to a second gradient at the transition point. The hydrocarbon well drilling system also including a drilling control system, including a motive system adapted to exert a horizontal motive force on the horizontally oriented starting end of the drill string to generate a force to facilitate the drill bit boring through the subsurface formation to create the wellbore having the sigmoid well trajectory.

In some embodiments, the wellhead body is partially disposed below the surface of the earth such that wellhead entrance is disposed above the surface of the earth, and the horizontally oriented underside of the wellhead body is disposed below the surface of the earth. In certain embodiments, the wellhead system includes a wellhead stabilizer including a cage disposed over an upper portion of the wellhead body to inhibit horizontal or vertical movement of the wellhead body. In some embodiments, the cage includes extensions that are secured to the surface of the earth. In certain embodiments, the cage includes one more lateral cage elements that extend laterally across the upper portion of the wellhead body, and one or more longitudinal cage elements that extend longitudinally across the upper portion of the wellhead body. In some embodiments, the wellhead passage includes an up-hole portion having a horizontally oriented trajectory, and a down-hole portion having a downward sloping trajectory that terminates at the wellhead exit. In certain embodiments, the up-hole portion of the wellhead passage includes a hanger section including one or more integrated shoulders for supporting components disposed in the wellbore. In some embodiments, the down-hole portion of the wellhead passage has a first internal diameter, and the hanger section includes the following: a casing hanger shoulder defined by a casing hanger portion of the up-hole portion of the wellhead passage having a second internal diameter that is greater than the first internal diameter; and a production tubing hanger shoulder defined by a production tubing hanger portion of the up-hole portion of the wellhead passage having a third internal diameter that is greater than the second internal diameter, the production tubing hanger portion being located up-hole from the casing hanger portion. In certain embodiments, the motive system includes a vehicle adapted to advance in a horizontal direction to exert the horizontal motive force on the starting end of the drill string. In some embodiments, the motive system includes a ram adapted to advance in a horizontal direction to exert the horizontal motive force on the starting end of the drill string. In certain embodiments, the generally horizontal portion of the first trajectory at the wellhead exit includes an entry angle in the range of 5° to 30° from horizontal. In some embodiments, the first gradient of the first trajectory at the inflection point of the wellbore includes an inflection angle in the range of 0° to 45° from vertical. In certain embodiments, the second gradient of the second trajectory at the transition point includes a transition angle in the range of 0° to 10° from horizontal. In some embodiments, the wellbore includes a horizontal portion of the wellbore extending from the transition point of the wellbore, where the horizontal portion of the wellbore including a third trajectory that matches the third gradient of the second sigmoid portion of the wellbore at the transition point and that has a horizontal gradient along its length. In certain embodiments, the horizontal gradient of the horizontal portion of the wellbore includes a gradient in the range of 0° to 15° from horizontal.

Provided in some embodiments is a method of drilling a hydrocarbon well. The method including installing a wellhead system, including disposing a wellhead body at a surface of the earth. The wellhead body including a wellhead passage adapted to guide a drill string from a horizontal orientation to a downward sloping orientation of a wellbore having a sigmoid well trajectory, the wellhead passage extending from a wellhead entrance at a vertically oriented side of the wellhead body to a wellhead exit at a horizontally oriented underside of the wellhead body. The method also including inserting a drill string into the wellhead passage (the drill string including a horizontally oriented starting end and a drill bit) and exerting a horizontal motive force on the horizontally oriented starting end of the drill string to generate a force to cause the drill bit to bore through the subsurface formation to create the wellbore having the sigmoid well trajectory. The wellbore including a first sigmoid portion extending from the wellhead exit to an inflection point of the wellbore. The inflection point being located downhole from the wellhead exit. The first sigmoid portion of the wellbore having a first trajectory that is generally horizontal at the wellhead exit of the wellbore and that increases in slope to a first gradient at the inflection point. The wellbore also including a second sigmoid portion extending from the inflection point of the wellbore to a transition point of the wellbore. The transition point being located downhole from the inflection point. The second sigmoid portion of the wellbore having a second trajectory that matches the first gradient of the first sigmoid portion of the wellbore at the inflection point and that decreases in slope to a second gradient at the transition point.

In some embodiments, disposing the wellhead body at the surface of the earth includes disposing a lower portion of the wellhead body below the surface of the earth such that wellhead entrance is disposed above the surface of the earth, and the horizontally oriented underside of the wellhead body is disposed below the surface of the earth. In some embodiments, installing the wellhead system includes installing a wellhead stabilizer including a cage disposed over an upper portion of the wellhead body to inhibit horizontal or vertical movement of the wellhead body. In certain embodiments, the cage includes extensions that are secured to the surface of the earth. In some embodiments, the cage includes one more lateral cage elements that extend laterally across the upper portion of the wellhead body, and one or more longitudinal cage elements that extend longitudinally across the upper portion of the wellhead body. In certain embodiments, the wellhead passage includes an up-hole portion having a horizontally oriented trajectory, and a down-hole portion having a downward sloping trajectory that terminates at the wellhead exit. In some embodiments, the up-hole portion of the wellhead passage includes a hanger section including one or more integrated shoulders for supporting components disposed in the wellbore. In certain embodiments, the down-hole portion of the wellhead passage has a first internal diameter, and the hanger section includes the following: a casing hanger shoulder defined by a casing hanger portion of the up-hole portion of the wellhead passage having a second internal diameter that is greater than the first internal diameter; and a production tubing hanger shoulder defined by a production tubing hanger portion of the up-hole portion of the wellhead passage having a third internal diameter that is greater than the second internal diameter, where the production tubing hanger portion is located up-hole from the casing hanger portion. In some embodiments, exerting a horizontal motive force to the horizontally oriented starting end of the drill string includes advancing a vehicle in a horizontal direction to exert the horizontal motive force on the starting end of the drill string. In some embodiments, exerting a horizontal motive force to the horizontally oriented starting end of the drill string includes advancing a ram in a horizontal direction to exert the horizontal motive force on the starting end of the drill string. In certain embodiments, the generally horizontal portion of the first trajectory at the wellhead exit includes an entry angle in the range of 5° to 30° from horizontal. In some embodiments, the first gradient of the first trajectory at the inflection point of the wellbore includes an inflection angle in the range of 0° to 45° from vertical. In certain embodiments, the second gradient of the second trajectory at the transition point includes a transition angle in the range of 0° to 10° from horizontal. In some embodiments, the wellbore includes a horizontal portion extending from the transition point of the wellbore, with the horizontal portion of the wellbore including a third trajectory that matches the third gradient of the second sigmoid portion of the wellbore at the transition point and that has a horizontal gradient along its length. In certain embodiments, the horizontal gradient of the horizontal portion of the wellbore includes a gradient in the range of 0° to 15° from horizontal.

Figure 1:
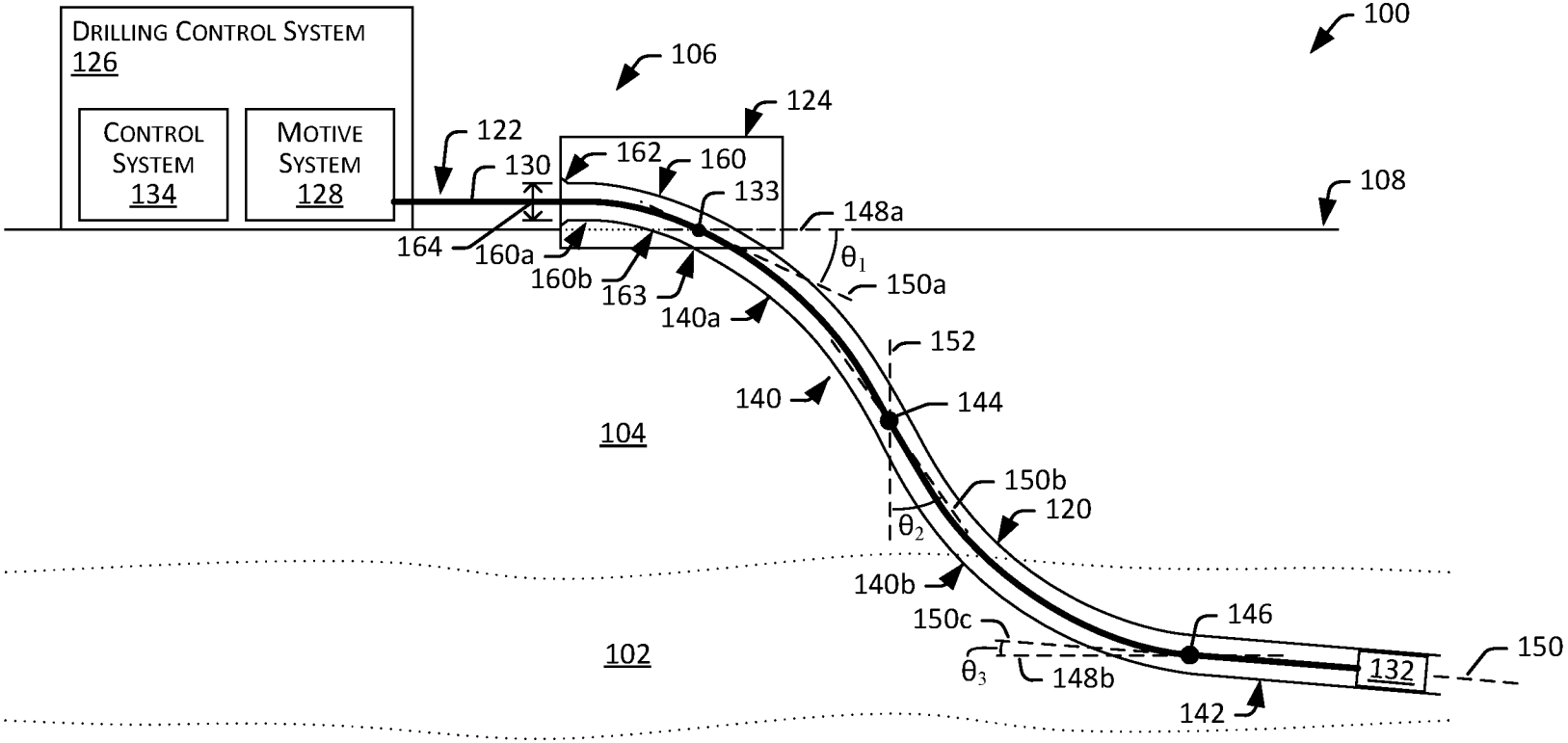
FIG. 1 is diagram that illustrates a well environment in accordance with one or more embodiments.

While this disclosure is susceptible to various modifications and alternative forms, specific embodiments are shown by way of example in the drawings and will be described in detail. The drawings may not be to scale. It should be understood that the drawings and the detailed descriptions are not intended to limit the disclosure to the particular form disclosed, but are intended to disclose modifications, equivalents, and alternatives falling within the spirit and scope of the present disclosure as defined by the claims.

DETAILED DESCRIPTION

Described are embodiments of systems and methods for drilling horizontally-oriented wells. In some embodiments, a horizontally-oriented well includes a sigmoid-shaped (or "S-shaped") horizontally-oriented wellbore. The sigmoid-shaped wellbore may include a sigmoid portion and a horizontal portion. The sigmoid portion may include a first (or "upper") sigmoid portion and a second (or "lower") sigmoid portion. The first sigmoid portion may have a downward curving wellbore trajectory (of gradually increasing slope relative to a horizontal plane), and the second sigmoid portion may have an upward curving wellbore trajectory (of gradually decreasing slope relative to the horizontal plane) that terminates into the horizontal portion of the wellbore. The horizontal portion of the wellbore may extend in a generally horizontal trajectory, for example, following a profile of a reservoir. The shape of the sigmoid portion of the wellbore can provide a vertical path through the formation that begins in a generally horizontal orientation and gradually increases in slope to a more vertical orientation, and then gradually decreases in slope back to a generally horizontal orientation, where it meets the horizontal portion of the wellbore. As a result, the wellbore can enter the earth in a generally horizontal orientation and not have the steep-vertical slope traditionally associated with at least the upper substantially-vertical wellbore portion of a vertically-oriented well.

Advantageously, such a sigmoid-shaped wellbore can enable a relatively high, non-vertical motive force to be applied to the drill string. For example, a horizontally-oriented well drilling system can include a horizontal driver (for example, a vehicle or a ram) that pushes the drill string horizontally, providing a relatively high motive force on the drill bit to facilitate the drill bit cutting (or "boring") through the earth.

As another advantage, the relatively shallow slope of the trajectory of the sigmoid shaped wellbore can reduce the hydrostatic pressure needed to lift fluids to the surface by way of the horizontally-oriented sigmoid shaped wellbore, relative to the hydrostatic pressure needed to lift fluids to the surface by way of a vertically-oriented wellbore. For example, in vertically-oriented wells the hydrostatic pressure is due mainly to the accumulation of fluids in the vertical portion of the wellbore, and the forces needed to lift the fluid must be sufficient to overcome the vertically-oriented downward force gravity acting on the vertically-oriented fluid column. In the sigmoid shaped wellbore, however, the fluid column (or at least a large portion of the fluid column) is not oriented vertically (for example, being oriented somewhat inclined or nearly horizontally) such that the downward force of gravity acting on the fluid column does not directly align with the orientation of fluid column. As a result, the forces need to lift the fluid in the non-vertical direction of the sigmoid shaped wellbore are relatively low in comparison to the forces needed to lift fluid in a vertically-oriented fluid column. As a result, the artificial lift requirements for a well having a sigmoid shaped wellbore can be eliminated or reduced in comparison with the artificial lift requirements for traditional wellbores containing substantially vertical sections.

Further, in a horizontally-oriented well, the drill string can enter the earth in a generally horizontal angle, such that a vertical rig is not required, reducing a height that the drilling system extends above the earth's surface. Also, the relatively low hydrostatic pressure needed to lift fluids to the surface by way of the wellbore can eliminate the need for pump-jacks (or at least larger and taller pump jacks) or other devices needed to create artificial lift. Thus, horizontally-oriented wells and the associated drilling and production systems can have a relatively low height profile when compared to the height profiles of vertically-oriented wells, and they can be a viable option in locations where height restrictions inhibit the use of traditional vertically-oriented drilling and production systems.

FIG. 1 is diagram that illustrates a well environment 100 in accordance with one or more embodiments. In the illustrated embodiment, the well environment 100 includes a hydrocarbon reservoir (a "reservoir") 102 located in a subsurface formation (a "formation") 104, and a well system (or "well") 106.

The formation 104 may include a porous or fractured rock formation that resides underground, beneath the earth's surface 108. The reservoir 102 may include a portion of the formation 104 that contains (or is at least determined or expected to contain) a subsurface pool of hydrocarbons, such as oil and gas. The reservoir 102 may include different layers of rock having varying characteristics, such as varying degrees of permeability, porosity, and resistivity. In the case of the well 106 being operated as a production well, the well 106 may facilitate the extraction (or "production") of hydrocarbons from the reservoir 102. In the case of the well 106 being operated as an injection well, the well 106 may facilitate the injection of fluids, such as water, into the reservoir 102. In the case of the well 106 being operated as a monitoring well, the well 106 may facilitate the monitoring of various characteristics of the reservoir 102, such reservoir pressure.

The well 106 may include a wellbore 120, a drill string 122, a wellhead system 124, and a drilling control system 126. The drill string 122 may include drill pipe 130 and a drill bit 132. As illustrated, the drill pipe 130 may extend from a surface location (for example, at or above the earth's surface 108) into the wellbore 120. The drilling control system 126 may include a motive system 128 and a control system 134. The motive system 128 may provide a motive force to push the drill string 122 into the wellbore 120 to, for example, facilitate the drill bit 132 cutting through the formation 104 in an efficient manner. The motive system 128 may provide a motive force to pull the drill string 122 to, for example, extract the drill string 122 from the wellbore 120. The control system 134 may control of various operations of the well 106, such as well drilling operations, well injection operations, and well and formation monitoring operations. In some embodiments, the control system 134 includes a computer system that is the same as or similar to that of computer system 1000 described with regard to at least FIG. 8.

The wellbore 120 may include a bored hole that enters the earth's surface 108 at an entry point (or "start point") 133, and extends through the formation 104 into a target zone or location, such as the reservoir 102. The wellbore 120 may, for example, be created by the drill bit 132 cutting through the formation 104 and into the reservoir 102. The wellbore 120 can provide for the circulation of drilling fluids during drilling operations, the flow of hydrocarbons (for example, oil and gas) to the earth's surface 108 from the reservoir 102 during production operations, the injection of fluids into one or both of the formation 104 and the reservoir 102 during injection operations, and the communication of monitoring devices (for example, logging tools) into one or both of the formation 104 and the reservoir 102 during monitoring operations (for example, in situ logging operations). The wellbore 120 may be cased or open holed. For example the wellbore 120 may include an elongated borehole having a cased upper portion that includes casing extending downward into an upper portion of the borehole from the earth's surface 108, and an uncased (or "open") lower portion that does not include casing in the borehole. The casing may include, for example, an annular casing, such as a hollow-cylindrical (or "tubular") steel pipe that extends into the borehole of the wellbore 120 and one or more layers of cement located in a casing-borehole annulus between an exterior surface of the casing and an interior surface of the borehole of the wellbore 120. Production tubing may be installed in the wellbore 120 to facilitate the flow of hydrocarbons to the earth's surface 108. For example, production tubing may be passed through an interior of the casing to provide a conduit for the flow of hydrocarbons or other production fluids through the wellbore 120.

The wellbore 120 may be a sigmoid-shaped (or "S-shaped") horizontally-oriented wellbore. For example, the wellbore 120 may include a sigmoid portion 140 and a horizontal portion 142. The sigmoid portion 140 may include a first (or "upper") sigmoid portion 140*a* and a second (or "lower") sigmoid portion 140*b*. The first sigmoid portion 140*a* may include a downward curving wellbore trajectory of gradually increasing slope (relative to horizontal), and the second sigmoid portion 140*b* may include an upward curving wellbore trajectory of gradually decreasing slope (relative to horizontal) that terminates into the horizontal portion 142 of the wellbore 120. The horizontal portion 142 of the wellbore 120 may extend in a generally horizontal trajectory, for example, having a slope (or "gradient") of +/−15° from horizontal through one or both of the formation 104 and the reservoir 102. The horizontal portion 142 of the wellbore 120 may, for example, follow a profile of the reservoir 102.

The first sigmoid portion 140*a* of the wellbore 120 may have a downward curving wellbore trajectory having generally horizontal trajectory (for example, parallel to the earth's surface 108) at or near the entry point 133 of the wellbore 120, and that increases in downward slope (relative to horizontal) to a somewhat vertical trajectory at an inflection point 144, where it meets the second sigmoid portion 140*b*. The second sigmoid portion 140*b* of the wellbore 120 may have an upward curving wellbore trajectory that shares the same downward slope as the first sigmoid portion 140*a* at the inflection point 144, and that decreases in downward slope (relative to horizontal) to a generally horizontal trajectory (for example, following the horizontal profile of the reservoir 102) at or near a horizontal transition point 146 of the wellbore 120. Thus, the first sigmoid portion 140*a* of the wellbore 120 may gradually drop-off to the inflection point 144, and the second sigmoid portion 140*b* of the wellbore 120 may gradually flatten-out to the transition point 146, where it meets with the horizontal portion 142 of the wellbore 120.

In some embodiments, the generally horizontal trajectory of the first sigmoid portion 140*a* at or near the entry point 133 of the wellbore 120 may have an entry angle ($\theta_1$) in the range of 0° to 30°. The entry angle ($\theta_1$) may be defined as an angle between horizontal (for example, parallel to the earth's surface 108) (represented by horizontal axis 148*a*) and an angle of a longitudinal axis 150 of the wellbore 120 at the entry point 133 (represented by axis 150*a*). In some embodiments, the somewhat vertical trajectory of the first sigmoid portion 140*a* and the second sigmoid portion 140*b* at the inflection point 144 of the wellbore 120 has an inflection angle ($\theta_2$) in the range of 0° to 45°. The inflection angle ($\theta_2$) may be defined as an angle between a vertical (for example, perpendicular to the earth's surface 108) (represented by vertical axis 152) and an angle of the longitudinal axis 150 of the wellbore 120 at the inflection point 144 (represented by axis 150*b*).

In some embodiments, the generally horizontal trajectory of the second sigmoid portion 140*b* at or near the transition point 146 of the wellbore 120 shares the same angle as the horizontal portion 142 of the wellbore 120 at or near the transition point 146. Thus, the wellbore 120 may have a smooth transition from the sigmoid portion 140 of the wellbore 120 into the horizontal portion 142 of the wellbore 120. In some embodiments, the generally horizontal trajectory of the second sigmoid portion 140*b* at or near the transition point 146 of the wellbore 120 has a transition angle ($\theta_3$) in the range of 0° to 10°. The transition angle ($\theta_3$) may be defined as an angle between horizontal (for example, parallel to the earth's surface 108) (represented by horizontal axis 148*b*) and an angle of the longitudinal axis 150 of the wellbore 120 at the transition point 146 (represented by axis 150*c*). The horizontal portion 142 of the wellbore 120 may extend in a generally horizontal direction, for example having a slope in the range of 0° to 15° from horizontal (for example, −15° to +15 degrees from horizontal). The horizontal portion 142 of the wellbore 120 may track in varying amounts of upward and downward slope to follow a suitable path for intersecting one or more target regions or locations, such as reservoir 102. For example, the horizontal portion 142 of the wellbore 120 may generally follow the horizontal profile of the reservoir 102. The horizontal portion 142 of the wellbore 120 may track across the height (or "depth") of the reservoir 102 to provide increased contact with the reservoir 102.

In some embodiments, the wellhead system 124 provides a structural and pressure-containing interface for the drilling and production equipment of the well 106. For example, the wellhead system 124 may include a structure that supports the weight of casing or other downhole components in the wellbore 120 that are suspended from the wellhead system 124. Further, the wellhead system 124 may include seals and valves that provide controlled access to portions of the wellbore 120, such as different annular regions between layers of casing or between an outer-casing and walls of the borehole of wellbore 120. During drilling operations, a blowout preventer may be coupled to the wellhead system 124 (for example, at a wellhead entrance 162) to control pressure in the wellbore 120. During production operations, a production tree may be coupled to the wellhead system 124 (for example, at a wellhead entrance 162) to control production flow rates and pressure.

In some embodiments, the wellhead system 124 includes a wellhead passage 160. The wellhead passage 160 may be in communication with the wellbore 120 and may contain the entry point 133 of the wellbore 120. The wellhead passage 160 may extend from a wellhead entrance 162 at a vertical oriented side of a wellhead body of the wellhead system 124, to a wellhead exit 163 at a horizontally oriented underside of the wellhead body. The generally horizontal trajectory of the first sigmoid portion 140*a* at or near the wellhead exit 163 may be the same or similar to the generally horizontal trajectory at entry point 133 of the wellbore 120 (for example, having an entry angle at the wellhead exit 163 (or "wellhead exit angle") in the range of 5° to 30°). The entry angle or wellhead exit angle at the wellhead exit may be defined as an angle between horizontal (for example, parallel to the earth's surface 108) and an angle of a longitudinal axis 150 of the wellbore 120 at the wellhead exit 163. The wellhead passage 160 may be a conduit that provides for guiding the advancement of components into the wellbore 120. For example, components may be inserted into the wellhead system 124 by way of a wellhead entrance 162 of the wellhead passage 160, and be guided into the wellbore 120 by the shape of the wellhead passage 160. In some embodiments, the wellhead passage 160 includes a trajectory that provides a smooth transition from a generally horizontal orientation (for example, −15° to +15 degrees from horizontal), to the trajectory of the wellbore 120 at or near the entry point 133 or the wellhead exit 163. For example, the wellhead passage 160 may have a downward curving trajectory, defined by an up-hole portion 160*a* of the wellhead passage 160 having a horizontal trajectory (for example, parallel to the earth's surface 108) at or near the wellhead entrance 162, and a down-hole portion 160*b* of the wellhead passage 160 that increases in downward slope to match the generally horizontal trajectory of the longitudinal axis 150 of the wellbore 120 at or near the entry point 133 (represented by axis 150*a*) or the wellhead exit 163. Thus, the wellhead passage 160 may provide a gradual transition from a horizontal orientation to the generally horizontal trajectory of the wellbore 120 at or near the entry point 133 of the wellbore 120 or the wellhead exit 163. This gradual transition may help to guide components into the wellbore 120. For example, as drill pipe 130 or other components of the drill string 122 are pushed in a horizontal direction by the motive system 128, the walls of the wellhead passage 160 may direct the associated forces from a horizontal direction along the length of the drill string 122 in a partially downward direction to guide the components into the wellbore 120. Such a wellhead passage 160 may enable the motive system to provide a pushing force in the horizontal direction, without buckling the drill pipe 130 during entry into the wellbore 120. In some embodiments, the wellhead passage 160 has a diameter 164 of about 20 inches. Embodiments of the wellhead system 124 are described in additional detail with regard to at least FIGS. 5A-6B.

Figure 2B:
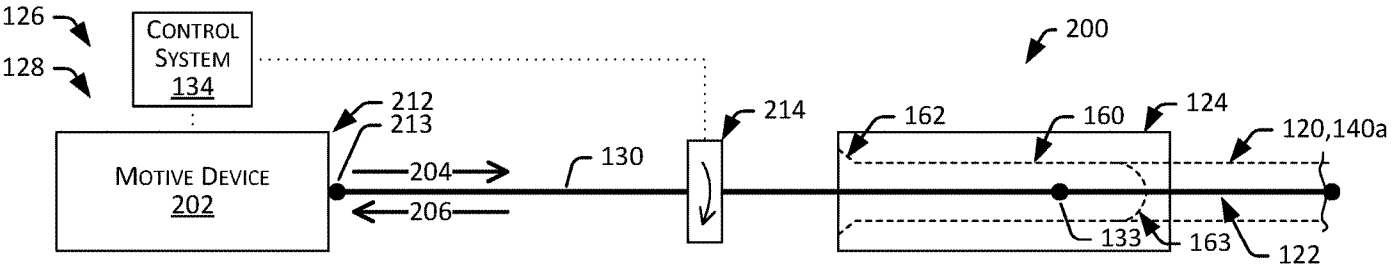
FIGS. 2A and 2B are diagrams that illustrate an example surface system of a horizontally-oriented well system in accordance with one or more embodiments.
Figure 2A:
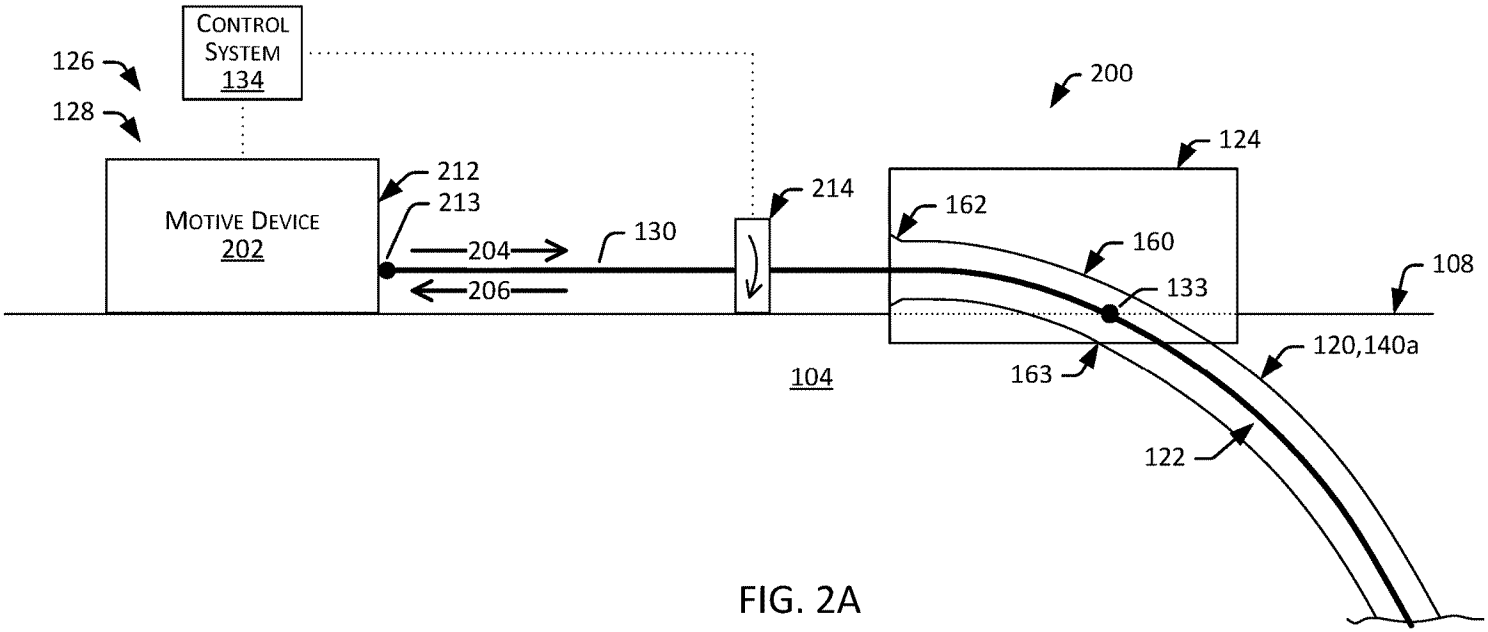

FIGS. 2A and 2B are diagrams that illustrate elevation and top views, respectively, of an example surface system 200 of the horizontally-oriented well system 106 in accordance with one or more embodiments. In some embodiments, the surface system 200 includes the drilling control system 126 and the wellhead system 124. As described, the drilling control system 126 may include the motive system 128 and the control system 134. In some embodiments, the motive system 128 includes a horizontally-oriented motive device 202 that is operable to insert (or "lower") components, such as the drill string 122, production tubing and logging tools, into the wellbore 120, and to extract (or "raise") components from the wellbore 120. For example, the motive system 128 may include a motive device 202 that is capable of providing one or both of a sufficient pushing force (for example, generally horizontally in the direction of arrow 204) to urge the drill string 122 or other components into the wellbore 120, and a sufficient pulling force (for example, generally horizontally in the direction of arrow 206) to extract the drill string 122 or other components from the wellbore 120. As described, it can be beneficial to apply a relatively high pushing force to the drill string 122 to, in turn, provide a sufficient pushing force at the drill bit 132 to facilitate the drill bit 132 cutting through the earth in an efficient manner. This can be especially true in a horizontally-oriented well system 106 to enable relatively long horizontal wellbore sections to be drilled. Also, it can be beneficial to apply a relatively high pulling force to the drill string 122 to extract the drill string 122 from the wellbore 120. This can be especially true in a horizontally-oriented well system 106 that has a relatively long horizontal wellbore portion 142 and, in turn, a relatively long and heavy drill string 122. In some embodiments, the motive device 202 provides a substantial amount of motive force needed for drilling and operating horizontally-oriented well systems. The motive device 202 can provide one or both of large pushing forces required to advance components into the wellbore 120 and large pulling forces to extract components from the wellbore 120. In some embodiments, the motive force is applied in a linear direction (for example, generally horizontally in the direction of arrow 204 or 206 and parallel to a longitudinal axis of the component being inserted into or removed from the wellbore 120) to ensure that the motive force is transferred longitudinally along a length of the component being inserted into or removed from the wellbore 120, and that the motive force does not create a lateral force of sufficient magnitude to bend or buckle the component.

In some embodiments, an insertion operation includes inserting one or more components, such as the drill string 122, into the wellbore 120. For example, an insertion operation may include retracting the motive device 202 (in the direction of arrow 206) to an insertion starting location that provides enough space between a leading end 212 of the motive device 202 and the wellhead entrance 162 of the wellhead system 124 to accept a first section of the drill pipe 130. A trailing end 213 of the first section of the drill pipe 130 may be coupled to the leading end 212 of the motive device 202. The motive device 202 may, then, be advanced (in the direction of arrow 204) by a distance about the length of the section of drill pipe 130, to push the drill string 122 (including the first section of drill pipe 130) toward and into one or both of the wellhead system 124 and the wellbore 120 by the distance. The walls of the wellhead passage 160 may guide the path of advancement of drill pipe 130 into the wellbore 120. Once the first section of drill pipe 130 is inserted, the motive device 202 may, again, be retracted (in the direction of arrow 206) to the insertion starting location, a leading end of a second section of drill pipe 130 may be coupled to the trailing end 213 of the first section of the drill pipe 130, a trailing end 213 of the second section of the drill pipe 130 may be coupled to the leading end 212 of the motive device 202, and the motive device 202 may, again, be advanced (in the direction of arrow 204) by a distance about the length of the second section of drill pipe 130, to push the drill string 122 (including the first and second sections of drill pipe 130) toward and into one or both of the wellhead system 124 and the wellbore 120 by the distance. Such an insertion operation can be repeated for any number of sections of drill pipe 130 and other components of the drill string 122, to advance the drill sting 122 into the wellbore 120. A similar insertion operation can be conducted for insertion of any variety of components into the wellbore 120.

In some embodiments, a leading end of the first section of drill pipe 130 is coupled to a trailing end of the drill bit 132, and the sections of drill pipe 130 are rotated as they are advanced to provide for rotation of the drill bit 132. The rotation of the drill bit 132 and the pushing force provided by the motive device 202 by way of the drill pipe 130 may facilitate the drill bit 132 cutting through the earth as the drill string 122 is advanced into the wellbore 120. In some embodiments, the rotation of the drill pipe 130 is provided by a horizontally-oriented drive system 214, such as a horizontally-oriented rotary table or side drive system. The rotary table depth or length in the well direction can be sufficient to sustain the drill pipe during pipe change, and can be stabilized against the drill floor.

In some embodiments, an extraction operation includes extracting one or more components, such as the drill string 122, from the wellbore 120. An extraction operation may generally be the reverse of an insertion operation. For example, referring to extraction of the drill string 122, the motive device 202 may be positioned at an extraction starting location at or near the wellhead system 124, and a trailing end 213 of a top (or "up-hole") section of the drill pipe 130 may be coupled to the leading end 212 of the motive device 202. The motive device 202 may, then, be retracted (in the direction of arrow 206) by a distance about the length of the section of drill pipe 130, to pull the drill string 122 (including the top section of drill pipe 130) away from and out of one or both of the wellhead system 124 and the wellbore 120 by the distance. The walls of the wellhead passage 160 may guide the path of extraction of the drill pipe 130 from the wellbore 120. The section of drill pipe 130 may be removed from the leading end 212 of the motive device 202, and the motive device 202 may, again, be advanced (in the direction of arrow 204) to the extraction starting location. A trailing end 213 of a next top (or "up-hole") section of the drill pipe 130 may be coupled to the leading end 212 of the motive device 202, the motive device 202 may, again, be retracted (in the direction of arrow 206) by a distance about the length of the section of drill pipe 130, to pull the drill string 122 (including the top section of drill pipe 130) away from and out of one or both of the wellhead system 124 and the wellbore 120 by the distance, and the top (or "up-hole") section of drill pipe 130 may be removed from the leading end 212 of the motive device 202. Such an extraction operation can be repeated for any number of sections of drill pipe 130 and other components of the drill string 122 to extract them from the wellbore 120. A similar extraction operation can be conducted for extraction of any variety of components from the wellbore 120.

In some embodiments, the motive device 202 includes a horizontally advanceable ram, such as a hydraulically or pneumatically driven piston, that can provide one or both of large pushing forces required to advance components into the wellbore 120 and large pulling forces to extract components from the wellbore 120. For example, in an embodiment in which the motive device 202 includes a ram, a piston of the ram may be extended (for example, by hydraulic or pneumatic actuation) (in the direction of arrow 204) such that a leading end 212 of the piston pushes against an up-hole end of a component (for example, the drill string 122) to push the component into the wellbore 120. The piston of the ram may be retracted (for example, by hydraulic or pneumatic actuation), while coupled to an up-hole end of a component (for example, the drill string 122), to pull the component out of the wellbore 120.

In some embodiments, the motive device 202 includes a horizontally advanceable vehicle, such as a locomotive (for example, a diesel locomotive), a truck or a tractor that can provide one or both of large pushing forces required to advance components into the wellbore 120 and large pulling forces to extract components from the wellbore 120. For example, in an embodiment in which the motive device 202 includes a vehicle, the vehicle may be driven forward (in the direction of arrow 204) such that a leading end 212 of the vehicle pushes against an up-hole end of a component (for example, the drill string 122) to push the component into the wellbore 120. The vehicle may be driven in reverse, while coupled to an up-hole end of a component (for example, the drill string 122), to pull the component out of the wellbore 120.

Figure 2D:
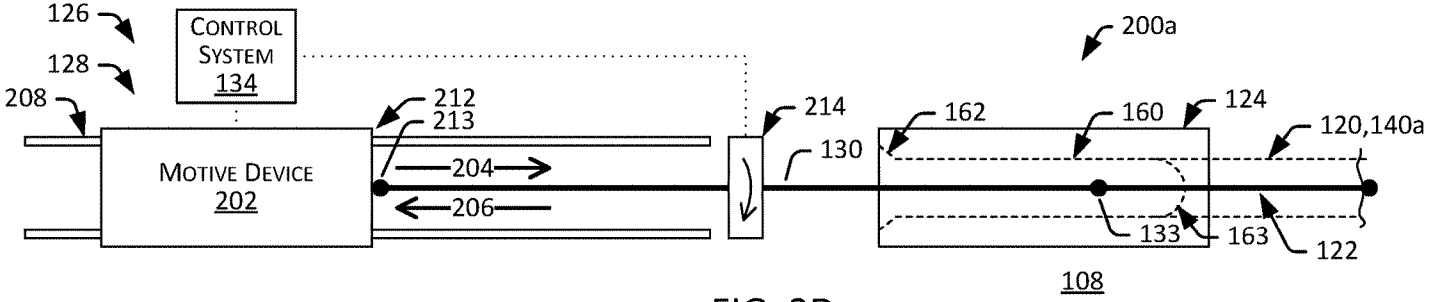
FIGS. 2C and 2D are diagrams that illustrate an example surface system of a horizontally-oriented well system employing rails in accordance with one or more embodiments.
Figure 2C:
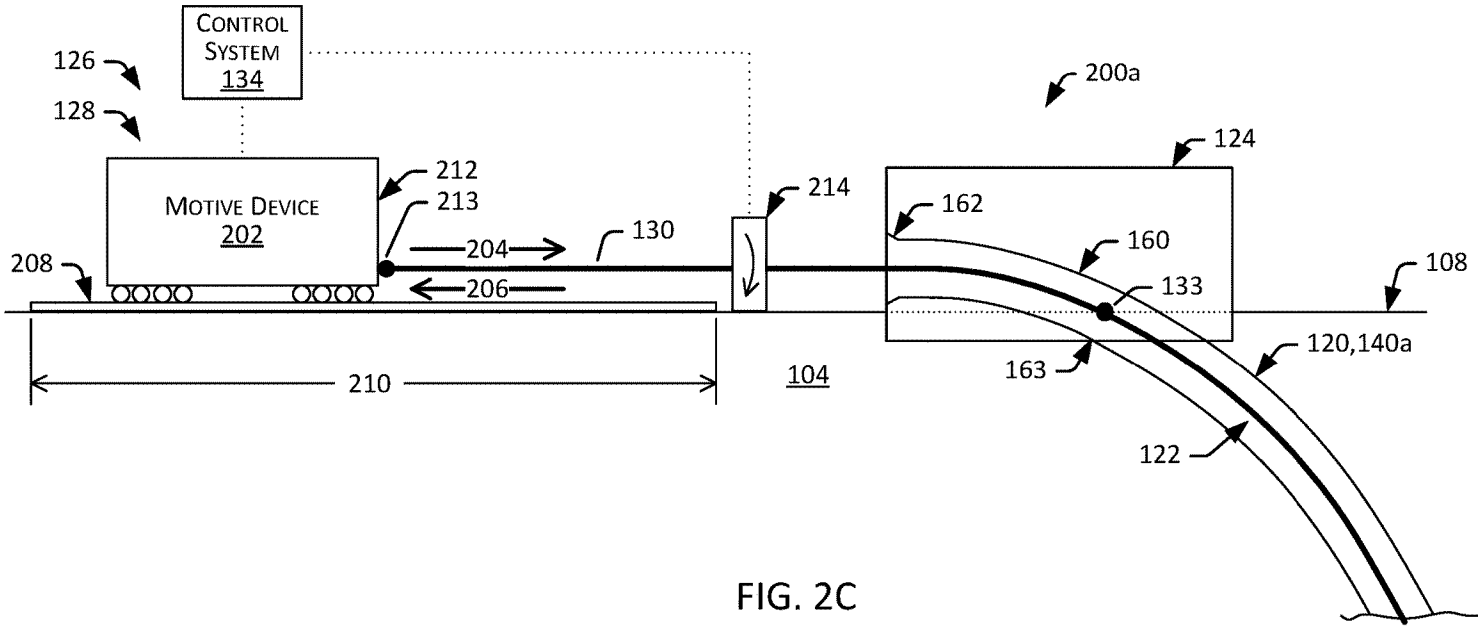

In some embodiments, the motive device 202 travels on rails, similar to that of a diesel train locomotive that travels on rail-road tracks. FIGS. 2C and 2D are diagrams that illustrate elevation and top views, respectively, of an example surface system 200*a* of the horizontally-oriented well system 106 employing rails in accordance with one or more embodiments. In such an embodiment, the motive device 202 may include a vehicle and the motive system 128 may include a horizontally-oriented rail segment 208 that guides forward and backward movement of the vehicle to advance components into the wellbore 120 and to extract components from the wellbore 120, respectively. Such a horizontally-oriented rail segment 208 can guide forward and backward movement of the vehicle to provide for application of the pushing and pulling forces in a linear direction (for example, generally horizontally in the direction of arrow 204 or 206 and parallel to a longitudinal axis of the component being inserted into or removed from the wellbore 120) to ensure that the motive force is transferred longitudinally along a length of the component being inserted into or removed from the wellbore 120, and that the motive force does not create a lateral force of sufficient magnitude to bend or buckle the component. The rail segment 208 may include a straight segment having a length 210 that allows the vehicle to move a distance that is equal to or greater than a length of a longest component to be installed in the wellbore 120 using the motive device 202. For example, in an embodiment in which the longest component to be installed in the wellbore 120 using the motive device 202 is a ten meter section of drill pipe 130 of the drill string 122 and the motive device 202 is a vehicle having a length of five meters, the rail segment 208 may have a length 210 of at least fifteen meters such that the motive device 202 can be moved at least ten meters across the rail segment 208. This may provide the necessary stoke length for insertion and extraction of components, such as drill pipe 130.

As discussed, horizontally-oriented well systems may provide certain advantages over existing vertically-oriented well systems. These advantages can include the following: the ability to provide a higher loading of the drill string and the drill bit, which can, in turn, provide for drilling of a horizontal wellbore section of extended length; a reduced hydrostatic pressure needed to lift fluids to the surface by way of the wellbore, which can, in turn, eliminate the need for pump-jacks (or at least larger/taller pump jacks) or other devices to create artificial lift that have a high profile extending above the earth's surface; or a relatively low height profile when compared to vertically-oriented wells, which can make horizontally-oriented well systems a viable option in locations where height restrictions inhibit the use of traditional vertically-oriented drilling and production systems.

Figure 3:
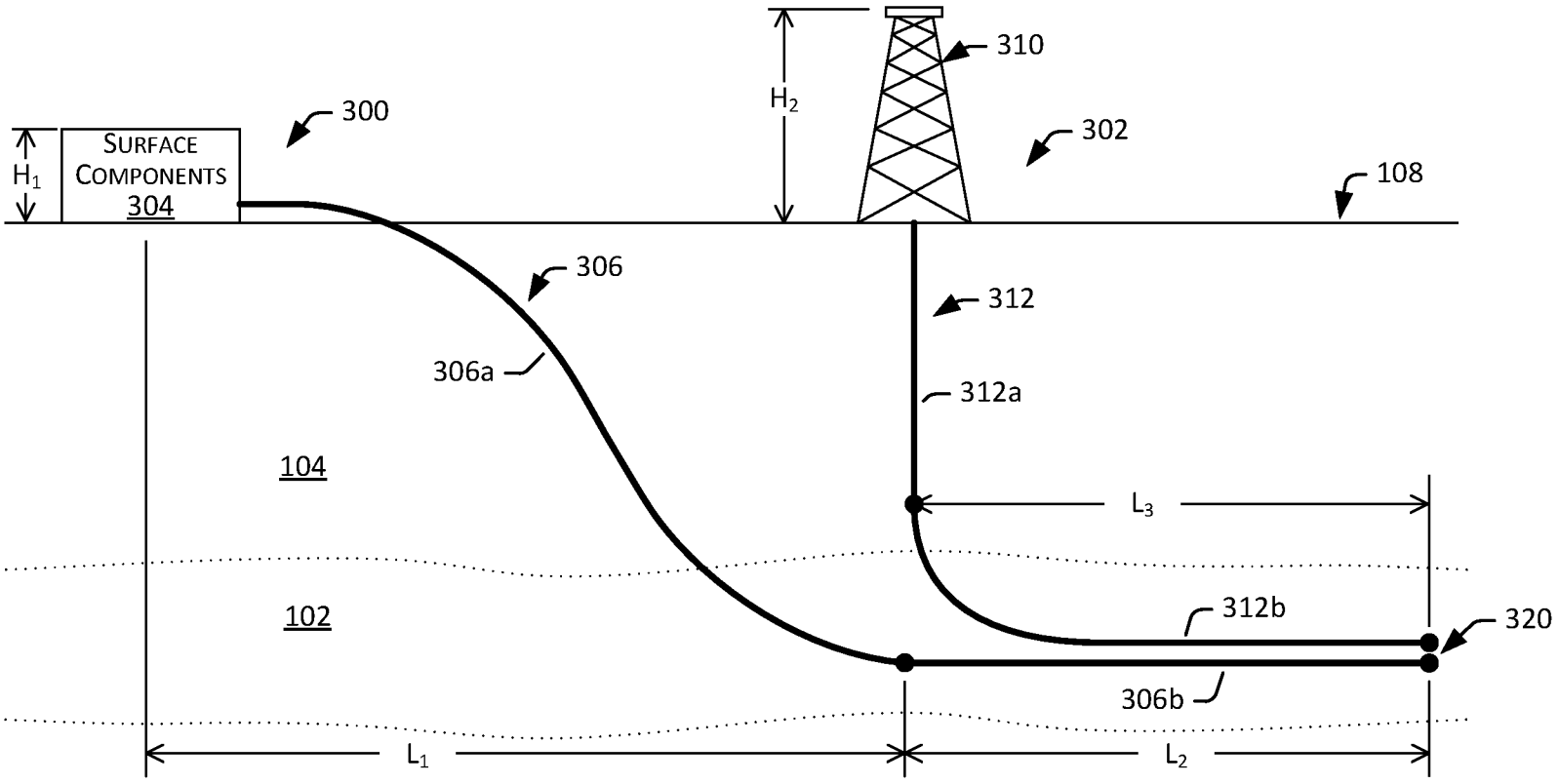
FIG. 3 is a diagram that illustrates different well trajectories in accordance with one or more embodiments.
Figure 4A:
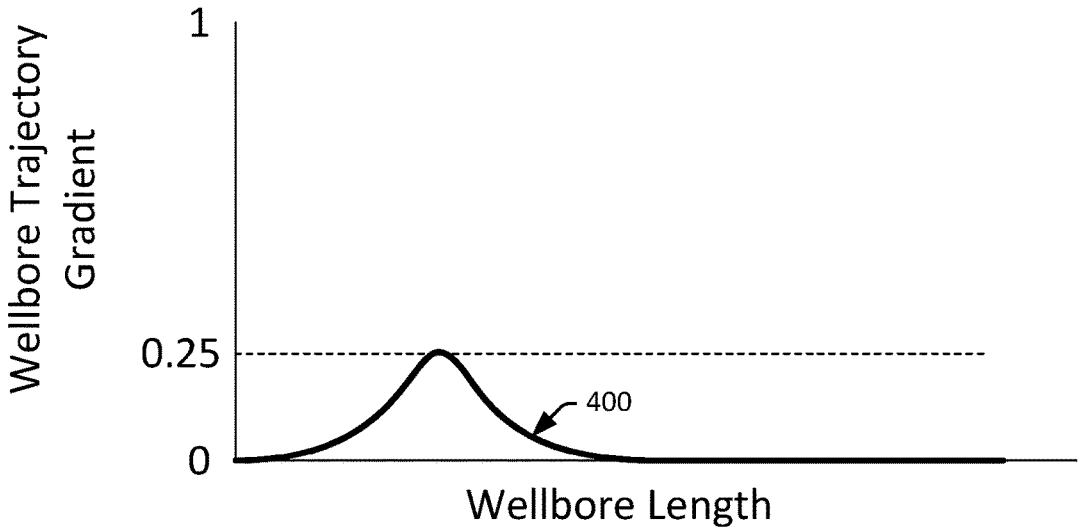
FIGS. 4A and 4B are diagrams that illustrate example gradients of well trajectories in accordance with one or more embodiments.
Figure 4B:
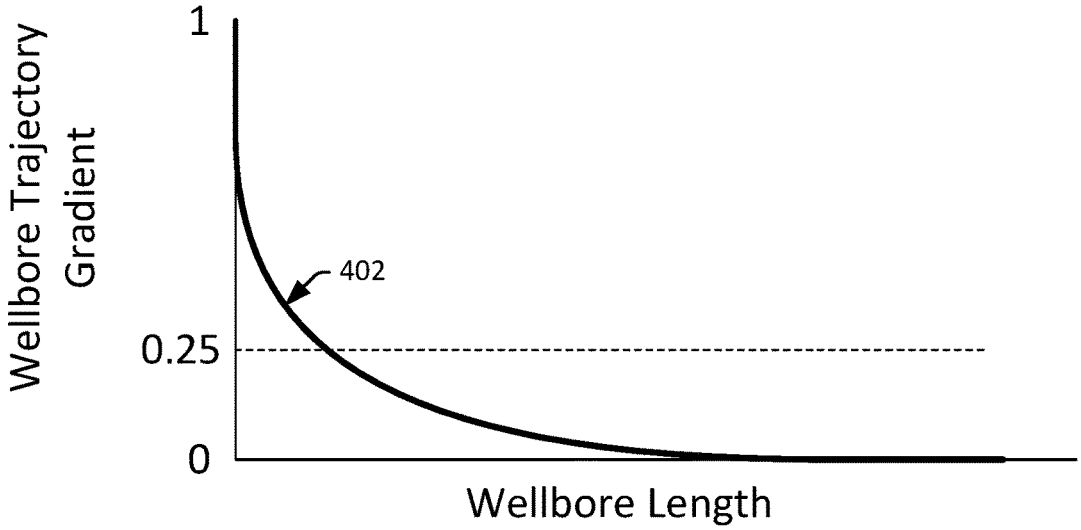

FIG. 3 is a diagram that illustrates different well trajectories in accordance with one or more embodiments. FIGS. 4A and 4B are diagrams that illustrate example gradients for well trajectories in accordance with one or more embodiments. These diagrams may help to illustrate certain advantages of horizontally-oriented well systems in comparison to traditional vertically-oriented well systems. Referring first to FIG. 3, the diagram illustrates example profiles of a horizontally-oriented well system 300 and a vertically-oriented well system 302, superimposed on one another for the sake of comparison. The horizontally-oriented well system 300 may have horizontal surface components 304 and a horizontally-oriented, sigmoid-shaped wellbore 306. The horizontal surface components 304 may include, for example, a wellhead system, a motive system (for example, a vehicle or ram) or a relatively short pumping jack, having a vertical height of $H_1$. The sigmoid-shaped wellbore 306 may include a sigmoid portion 306*a* having a horizontal length of $L_1$ and a horizontal portion 306*b* having a horizontal length of $L_2$. The vertically-oriented well system 302 may have vertical surface components 310 and a traditional, vertically-oriented wellbore 312. The vertical surface components 310 may include, for example, a vertically-oriented wellhead system, a vertically-oriented drilling rig, or a relatively tall pumping jack, having a vertical height of $H_2$. The vertically-oriented wellbore 312 may include a vertical portion 312*a* and a horizontal portion 312*b* having a horizontal length of $L_3$.

The horizontal portion 306*b* of the horizontally-oriented sigmoid-shaped wellbore 306 of the horizontally-oriented well system 300 may be drilled to have a greater length than the horizontal portion 312*b* of the vertically-oriented wellbore 312 of the vertically-oriented well system 302, such that $L_2$ is greater than $L_3$. This may be a result of the horizontally-oriented well system 300 being able to provide increased pushing force on the drill string 122 during drilling operations. As a result, the horizontally-oriented well system 300 may be able to reach a target location 320 from a greater horizontal distance than a vertically-oriented well system 302. For example, the surface components 304 of the horizontally-oriented well system 300 can be located a distance that is equal to about the sum of $L_1$ and $L_2$ from the target location 320, whereas the surface components 310 of the vertically-oriented well system 302 may have be located a distance that is equal to only about $L_3$ or less from the target location 320. In addition to the horizontal reach advantages of the horizontally-oriented well system 300, the height ($H_1$) associated with the horizontal surface components 304 may be considerably less than the height ($H_2$) associated with the vertical surface components 310. As a result, the horizontally-oriented well system 300 may be a viable option in locations where height restrictions inhibit the use tall surface components, such as those of the traditional vertically-oriented drilling system 302.

Referring to FIGS. 4A and 4B, regarding the slope (or "gradients") of well trajectories, FIG. 4A illustrates a plot of an example gradient 400 of the trajectory of the wellbore 306 of the horizontally-oriented well system 300 in accordance with one or more embodiments, and FIG. 4B illustrates a plot of an example gradient 402 of the trajectory of the wellbore 312 of the vertically-oriented well system 302 in accordance with one or more embodiments. As can be seen, the gradient 400 of the trajectory of the wellbore 306 of the horizontally-oriented well system 300 may remain relatively low (for example, not exceeding a value of about 0.25), whereas the gradient 402 of the trajectory of the wellbore 312 of the vertically-oriented well system 302 may be relatively high (for example, reaching a maximum value of about 1, corresponding to true vertical). As will be appreciated the lower gradient may reduce the hydrostatic pressure needed to lift fluids to the surface 108 and may reduce the forces to support components (for example, the drill string) in the wellbore 306 and the forces to extract components from the wellbore 306. As discussed, the relatively low hydrostatic pressure needed to lift fluids to the surface by way of the wellbore 306 can eliminate the need for pump-jacks (or at least larger and taller pump jacks) or other devices used to create artificial lift that can extend above the earth's surface 108. Also, the reduced forces to support components (for example, the drill string 122) in the wellbore 306 and the reduced forces to extract components from the wellbore 306 can eliminate the need for larger motive devices (or other devices) for supporting and extracting the components.

As described here, the wellhead system 124 may provide a structural and pressure-containing interface for the drilling and production equipment of the well 106. For example, the wellhead system 124 may include a secured structural assembly that resists vertical and horizontal forces, such as those imposed by mechanical interaction with well components, such as drill pipe 130 as it is advanced through the wellhead system 124, and fluid forces, such as the force generated by high-pressure production fluids in the wellbore 120. It can be critical that the wellhead system 124 maintain structural integrity and remain stationary during development of the well 106, as movement of the wellhead system 124 can create cascading issues. For example, even a relatively small movement of the wellhead system 124 can cause casing pipe in the wellbore 120 to move, which can, in turn, cause the casing cement surrounding the casing pipe to crack or separate from the formation. Such compromises in the integrity of the casing can lead to failure of the well, including substances uncontrollably bypassing the casing. In some embodiments, the wellhead system 124 employs a rigid structure that is secured in place to prevent undesirable movement of the wellhead system 124.

Figure 5A:
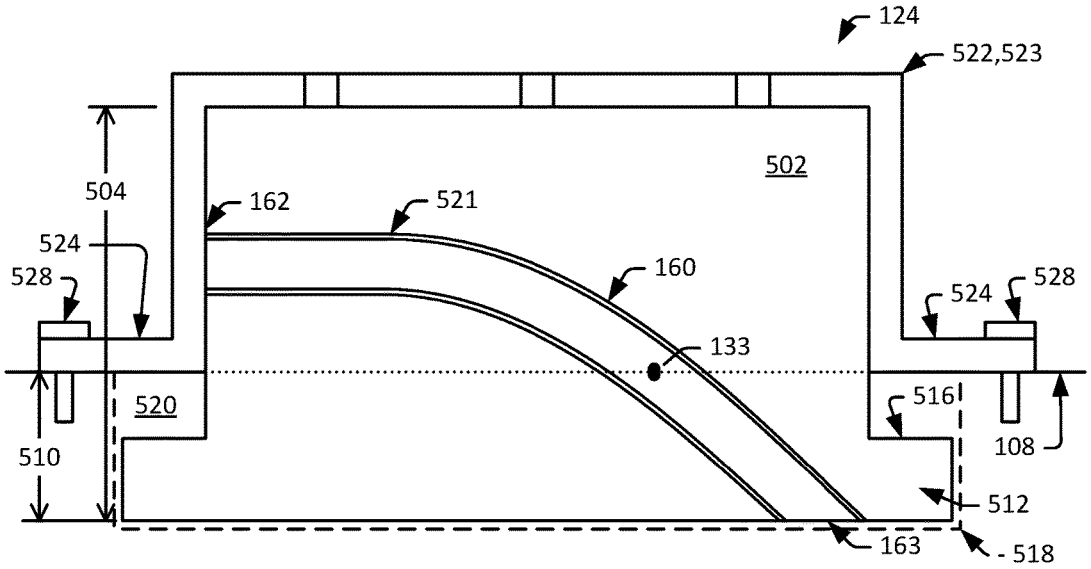
FIGS. 5A-6B are diagrams that illustrate example wellhead systems of a horizontally-oriented well system in accordance with one or more embodiments.
Figure 5B:
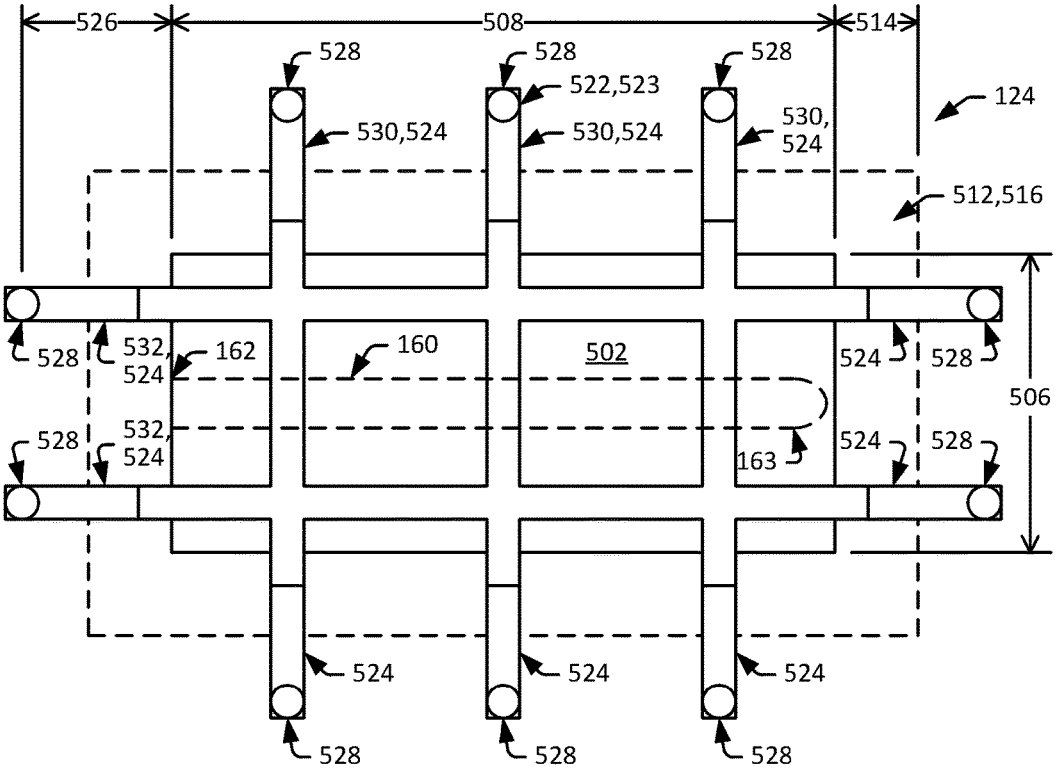

FIGS. 5A and 5B are diagrams that illustrate elevation and top views, respectively, of an example wellhead system 124 of the horizontally-oriented well system 106 in accordance with one or more embodiments. In some embodiments, the wellhead system 124 includes a wellhead body 502. The wellhead body 502 may include block that is installed at or near the entry point 133 of the wellbore 120. For example, the wellhead body 502 may include a rectangular block having a height 504 of about 5-10 meters (m), a width 506 of about 3-5 m, and a length 508 of about 10-50 m, including the wellhead passage 160 formed in the wellhead body 502.

The wellhead body 502 may be of sufficient length to facilitate the wellhead passage 160 having a gradual curvature that enables the wellhead passage 160 to enter in a horizontal orientation at a vertically oriented side of the wellhead body 502 (for example, at the wellhead entrance 162), and exit at a more vertical orientation from a horizontally oriented underside of the wellhead body 502 (for example, at the wellhead exit 163). For example, if the wellhead passage 160 requires about 30 m in length to transition from a horizontal orientation to the more vertical orientation, the wellhead body 502 may have a length of about 50 m to accommodate the horizontal span of the wellhead passage 160. The wellhead body 502 may be of sufficient height to facilitate the wellhead passage 160 having a gradual curvature that enables the wellhead passage 160 to enter in a horizontal orientation at a vertically oriented side of the wellhead body 502 (for example, at the wellhead entrance 162), and exit at a more vertical orientation from a horizontally oriented underside of the wellhead body 502 (for example, at the wellhead exit 163). For example, if the wellhead passage 160 requires about 7 m in height to transition from a horizontal orientation to the more vertical orientation, the wellhead body 502 may have a height of about 10 m to accommodate the vertical span of the wellhead passage 160.

In some embodiments, at least a portion of the wellhead body 502 is installed below the earth's surface 108. For example, the wellhead body 502 may be installed at a depth 510 of about 2-5 m. The installation of at least bottom portion of the wellhead body 502, below the earth's surface 108 (or "underground"), may inhibit horizontal (or "side-to-side") movement of the wellhead body 502. The portion of the wellhead body 502 extending above the earth's surface 108 may be referred to as the "top" or "upper" portion of the wellhead body 502, and the portion of the wellhead body 502 extending below the earth's surface 108 may be referred to as the "bottom" or "lower" portion of the wellhead body 502

In some embodiments, the wellhead body 502 is formed of a relatively heavy material. For example, the wellhead body 502 may be formed of concrete or steel. The use of a relatively heavy material may result in the wellhead body 502 having a relatively high weight, which can help to prevent movement of the wellhead body 502 and the wellhead system 124, once installed.

In some embodiments, the wellhead body 502 includes a footing. For example, the wellhead body 502 may include a footing 512, including a lateral protrusion that extends in a horizontal direction, from a base of some or all the vertical sides of the wellhead body 502. The footing 512 may have a width 514 of about 1-3 m, defined by the distance the footing 512 extends from the vertical sides of the wellhead body 502. The footing 512 may extend in equal or different distances from each of the vertical sides of the wellhead body 502. When the wellhead body 502 is installed, a top surface (or "shoulder") 516 of the footing 512 may be located below the earth's surface 108, and may be covered with another material, such as dirt, rock or concrete to inhibit vertical (or "up-and-down") movement of the wellhead body 502 and the wellhead system 124.

In some embodiments, the wellhead body 502 is formed and subsequently installed at the drilling site. For example, the wellhead body 502 may be prefabricated offsite, or even at the well site, a wellhead depression (or "wellhead hole") 518 (for example, a hole of at least the length and width of the wellhead body 502, and of a depth corresponding to a depth to which a bottom portion of the wellhead body 502 is to be submerged below the earth's surface 108) is formed in the earth's surface 108 at or near the entry point 133 for the wellbore 120, and the wellhead body 502 is transported to and installed in the wellhead depression 518. During installation, filler material 520, such as dirt, rock, or concrete may be positioned around the exterior of the wellhead body 502 to secure the wellhead body 502 in place. In some embodiments, the wellhead body 502 is formed in-place, at the drilling site. For example, the wellhead depression 518 may be formed in the earth surface 108 at or near the entry point 133 for the wellbore 120, a mold (or "form") may be installed in and around the wellhead depression 518, and material, such as cement, may be poured into the mold to form the wellhead body 502 in-place, in the wellhead depression 518. Once the wellhead body 502 has cured, the mold may be removed and filler material 520, such as dirt, rock, or concrete, may be positioned around the exterior of the wellhead body 502, as needed, to secure the wellhead body 502 in place.

In some embodiments, some or all of the wellhead passage 160 is pre-formed in the wellhead body 502. For example, the wellhead passage 160 may be formed (for example, molded or bored) in the wellhead body 502 at the time the wellhead body 502 is formed, prior to the wellhead body 502 being installed in the wellhead depression 518 at the well site. Such a technique may eliminate the need to drill the wellhead passage 160, after the wellhead body 502 is installed at the well site. In some embodiments, some or all of the wellhead passage 160 is formed in the wellhead body 502, after the wellhead body 502 is installed at the well site. For example, the wellhead passage 160 may be bored through the wellhead body 502 after the wellhead body 502 is installed in the wellhead depression 518 at the well site. Such a technique may provide a well operator with the flexibility to drill the wellhead passage 160 in a manner to accommodate needs of the particular well. As a further example, a first portion of the wellhead passage 160 (for example, including a hanger section) is formed in the wellhead body 502 at the time the wellhead body 502 is formed, prior to being the wellhead body 502 being installed in the wellhead depression 518 at the well site, and the remainder of the wellhead passage 160 is bored through the wellhead body 502 after the wellhead body 502 is installed in the wellhead depression 518 at the well site. Such a technique may eliminate the need to form complex features of the wellhead passage 160 at the well site, while still providing a well operator with the flexibility to drill the down-hole portion of the wellhead passage 160 in a manner to accommodate needs of the particular well.

In some embodiments, the wellhead passage 160 includes a passage liner 521. The passage liner 521 may include a sleeve or tubing that lines the wellhead passage 160 to facilitate the sliding of components against the well of the wellhead passage 160 as they are moved through the wellhead passage 160 of the wellhead body 502. The passage liner 521 may be formed of steel, titanium, a plastic, or a ceramic. In some embodiments, the passage liner 521 is removable. Thus, for example, a first passage liner 521 that has become worn, may be removed and a second passage liner 521 that is new or otherwise not worn, can be installed to facilitate the movement of components through the wellhead passage 160. Such a passage liner 521 may protect the walls of the wellhead body 502 forming the wellhead passage 160, from wear. Thus, for example, the wellhead body 502 may be formed of a relatively heavy, low cost material, such as concrete or low grade steel, that is prone to wear, and the passage liner 521 may be formed of a wear resistant material, such a high strength steel or titanium, that provides a cost effective solution for inhibiting wear of the walls of the wellhead body 502 forming the wellhead passage 160. In some embodiments, the passage liner 521 may be used to protect certain features of the wellhead body 502 and the wellhead passage 160. For example, if the wellhead passage 160 includes a hanger section (for example, having casing and production tubing shoulders as described with regard to at least FIGS. 6A and 6B), then during a first set of drilling operations a first passage liner 521 covering at least the hanger section, may be installed to prevent the drill string 122 from damaging the hanger section, and a second passage liner 521 covering the remainder of the wellhead passage 160, may be installed to prevent the drill string from damaging the portions of the wellhead passage 160 down hole from the hanger section. Once the wellbore 120 is ready for the installation of casing, the first passage liner 521 may be removed to expose the hanger section, and the casing hanger and the production hanger may be installed to the casing shoulder and production tubing shoulder, respectively, of the hanger section.

In some embodiment, the wellhead system 124 includes a wellhead stabilizer 522. For example, the wellhead system 124 may include a wellhead stabilizer 522, including a cage 523 that is deposited over a top portion of the wellhead body 502. The cage 523 may have lateral extensions 524 that are secured to the earth's surface 108 by way of fastening devices 528 installed some distance 526 (for example, 5 m or more) away from the sides of the wellhead body 502 *f* the extent of the footing 512. The wellhead stabilizer 522 may secure the wellhead body 502 in place, to inhibit horizontal or vertical movement of the wellhead body 502 and the wellhead system 124. The cage 523 may include one more lateral cage elements 530 that extend laterally across a width of the top portion of the wellhead body 502, or one or more longitudinal cage 532 elements that extend longitudinally across a length of the top portion of the wellhead body 502. In some embodiments the lateral or longitudinal cage elements 530 or 532 include rigid structures, such as steel beams, that are erected about the exterior of the wellhead body 502. In some embodiments the lateral or longitudinal cage elements 530 or 532 include flexible structures, such as steel cables, that are stretched about the exterior of the upper portion of the wellhead body 502. The fastening devices 528 may include threaded fasteners, spikes or piles that extend into the earth's surface 108, and that are coupled to the cage 523 to inhibit horizontal or vertical movement of the cage 523. The securing force provided by the wellhead stabilizer 522 may allow the size or weight of the wellhead body 502 to remain relatively low, as the securing force of wellhead stabilizer 522 may assist the weight of the wellhead body 502 or the footing 512, to inhibit horizontal or vertical movement of the wellhead body 502 and the wellhead system 124. A relatively low weight or size of the wellhead body 502 may reduce the material needed to form the wellhead body 502, and may facilitate the transport of the wellhead body 502, helping to reduce the time and cost to form and install the wellhead system 124.

In some embodiments, the wellhead passage 160 of the wellhead system 124 includes various features that facilitate the installation of well drilling and completion components, such as wellbore casing and production tubing. For example, the wellhead passage 160 may include a hanger section that includes a casing shoulder for installation (or "hanging") of casing in the wellbore 120 or a production shoulder for the for installation (or "hanging") of production tubing in the wellbore 120.

Figure 6A:
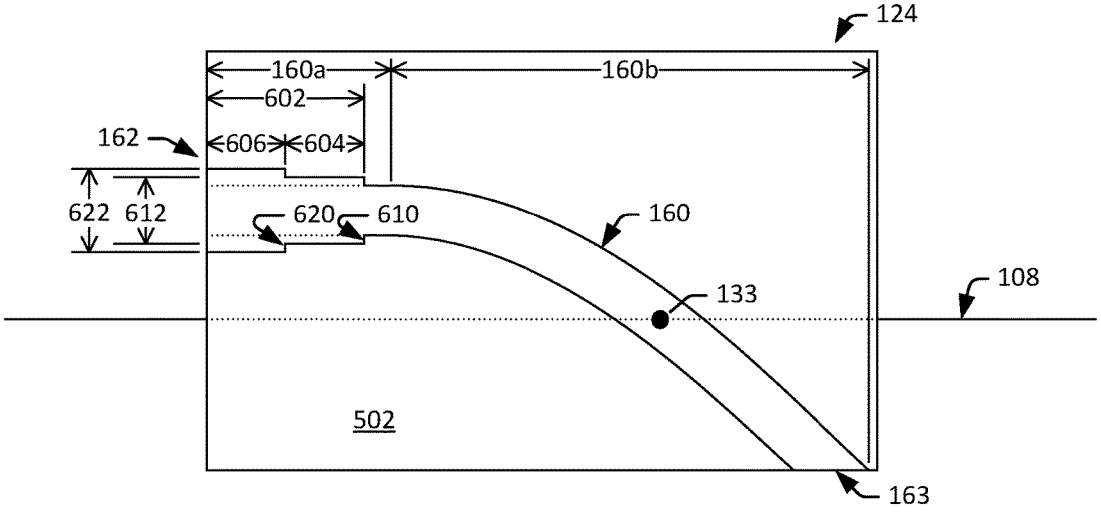
Figure 6B:
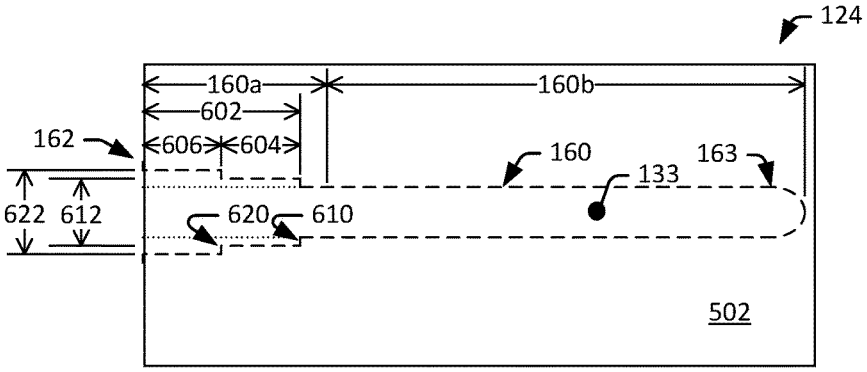

FIGS. 6A and 6B are diagrams that illustrate elevation and top views, respectively, of an example wellhead system 124, including a wellhead passage 160 in accordance with one or more embodiments. In some embodiments, the wellhead passage 160 includes a hanger section 602. The hanger section 602 may include a portion of the wellhead passage 160 that is adapted to provide for securing of casing or production tubing within the wellbore 120.

In some embodiments, the hanger section 602 is located in the up-hole portion 160*a* of the wellhead passage 160. For example, the hanger section 602 may extend from the wellhead entrance 162 into the wellhead body 502. Providing the hanger section 602 at the up-hole end of the wellhead passage 160 may provide for relatively easy access to the hanger section 602 and components installed in the hanger section 602, such as a casing hanger, a production tubing hanger, casing and production tubing. This can help to reduce cost and complexity associated with installation, inspection or maintenance of the hanger section 602, or components installed in the hanger section 602.

In some embodiments, the hanger section 602 is a horizontally oriented, straight section. For example, the hanger section 602 may define the up-hole portion 160*a* of the wellhead passage 160 having a straight, horizontal orientation, and that terminates into the downhole portion 160*b* of the wellhead passage 160 that provides a gradual transition, for example curving downward, from the horizontal orientation to the generally horizontal trajectory of the wellbore 120 at or near the entry point 133 of the wellbore 120 or the wellhead exit 163. In some embodiments, the hanger section 602 includes a casing hanger section 604 and a production hanger section 606. The casing hanger section 604 may include a casing hanger shoulder 610. During a casing installation operation, casing may be installed through the wellhead passage 160, and a shoulder of a casing hanger secured to an up-hole end of the casing may engage the casing hanger shoulder 610, such that the casing hanger shoulder 610 supports the weight of the casing extending downhole from the casing hanger. The casing hanger section 604 may be defined by a portion of the wellhead passage 160 having a diameter 612 that is greater than the diameter 164 of the wellhead passage 160. For example, the diameter 612 may be about 25 inches. The production tubing hanger section 606 may include a production tubing hanger shoulder 620. During a production tubing installation operation, production tubing may be installed through the wellhead passage 160, inside of already installed casing, and a shoulder of a production tubing hanger secured to an up hole end of the production tubing may engage the production tubing hanger shoulder 620, such that the production tubing hanger shoulder 620 supports the weight of the production tubing extending downhole from the production tubing hanger. The production tubing hanger section 606 may be defined by a portion of the wellhead passage 160 having a diameter 622 that is greater than the diameter 164 of the wellhead passage 160 or the diameter 612 of the casing hanger section 604. For example, the diameter 622 may be about 30 inches.

Figure 7:
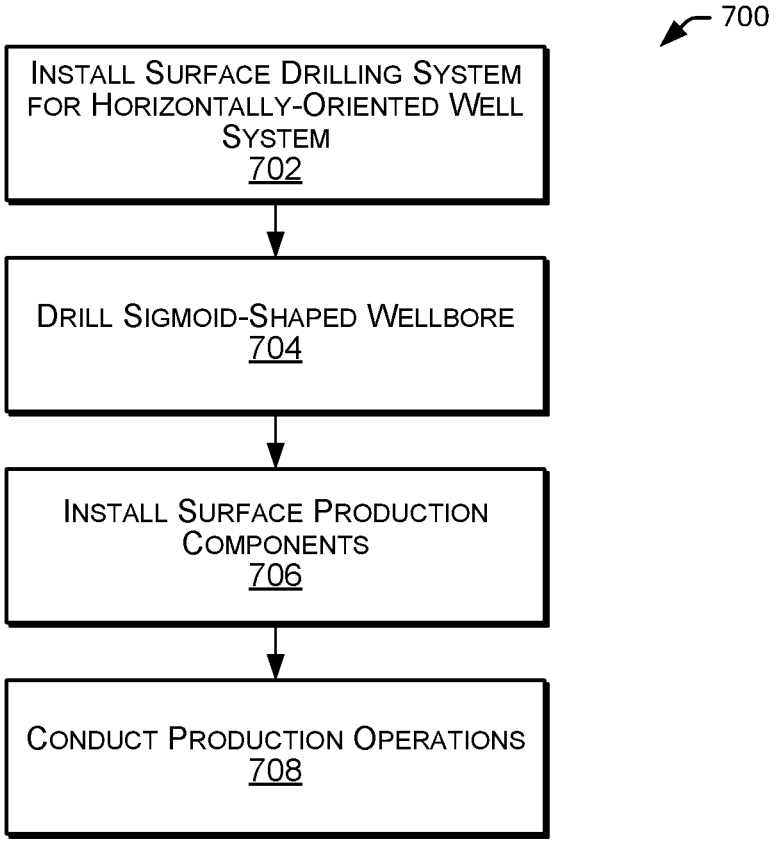
FIG. 7 is a flowchart that illustrates a method of drilling and operating a horizontally-oriented well in accordance with one or more embodiments.

Although certain embodiments of the wellhead system 124 are described independent of one another for the sake of clarity, embodiments can incorporate features of different embodiments. For example, the wellhead system 124 may include the wellhead body 502 having the footing 512 and being surrounded by the cage 523, as described with regard to FIGS. 5A and 5B, and having the wellbore 120 with the hanger section 602, as described with regard to FIGS. 6A and 6B. The combination of such features may provide a secure wellhead assembly 124 that guides drilling of the sigmoid-shaped wellbore 120, that facilitates the installation and securing of casing and production tubing in the wellbore 120, and that provides a solid and stable foundation to inhibit compromise of the casing in the wellbore 120. FIG. 7 is a flowchart that illustrates a method 700 of drilling and operating a horizontally-oriented well system in accordance with one or more embodiments. The method 700 may generally include installing a surface drilling system for a horizontally-oriented well system (block 702), drilling a sigmoid-shaped wellbore (block 704), installing surface production components (block 706), and conducting production operations (block 708).

In some embodiments, installing a surface drilling system for a horizontally-oriented well system (block 702) includes installing the surface components to facilitate drilling of a sigmoid-shaped wellbore. For example, installing a surface drilling system for a horizontally-oriented well system may include installing the wellhead system 124, and a drilling control system 126 that includes the motive system 128 and the control system 134. Installation of the wellhead system 124 may include installation of the wellhead body 502 as described, installation of the wellhead stabilizer 522 as described, or forming of the wellhead passage 160 (for example, including the hanger section 602) as described. The motive system 128 may include the motive device 202, such as a vehicle or a ram.

In some embodiments, drilling a sigmoid-shaped wellbore (block 704) includes drilling the sigmoid-shaped wellbore 120 using the installed surface drilling system. For example, drilling a sigmoid-shaped wellbore may include sequentially inserting and advancing components of the drill string 122 (for example, including the sections of drill pipe 130) into the wellbore 120 to advance the drill bit 132 along the trajectory of the wellbore 120. This can include, operating the motive system 128 to provide a generally horizontal motive force on the drill string 122 that is directed, by the wellhead passage 160 of the wellhead system 124, along the length of the drill string 122. In some embodiments, the control system 134 controls operation of the motive system 128 and the horizontally-oriented drive system 214 to cause the drill bit 132 to follow a path corresponding to the desired sigmoid-shaped trajectory. For example, the control system 134 may control operation of the motive system 128 and the horizontally-oriented drive system 214 to provide a suitable combination of pushing force and rotation to the drill string 122 to steer the drill bit 132 to follow a path corresponding to the desired sigmoid-shaped well trajectory. The wellbore trajectory may be similar to that of wellbore 120 described with regard to at least FIG. 1. For example, the wellbore 120 may include the sigmoid portion 140 and the horizontal portion 142. The sigmoid portion 140 may include the first (or "upper") sigmoid portion 140*a* and the second (or "lower") sigmoid portion 140*b*. The first sigmoid portion 140*a* may include a downward curving wellbore trajectory of gradually increasing slope (relative to horizontal), and the second sigmoid portion 140*b* may include an upward curving wellbore trajectory of gradually decreasing slope (relative to horizontal) that terminates into the horizontal portion 142 of the wellbore 120. The horizontal portion 142 of the wellbore 120 may extend in a generally horizontal trajectory, for example, having a slope (or "gradient") of about +/−15° from horizontal through one or both of the formation 104 and the reservoir 102. The horizontal portion 142 of the wellbore 120 may, for example, follow the horizontal profile of the reservoir 102.

In some embodiments, installing surface production components (block 706) includes installing devices suitable for extracting hydrocarbons from a reservoir by way of the horizontally-oriented well. For example, if the reservoir pressure is high enough to cause hydrocarbons (for example, oil and gas) to flow from the reservoir 102 to the earth's surface 108 by way of the wellbore 120 at a suitable rate, installing surface production components may include installing a production tree to the wellhead system 124. Such a wellhead system 124 and production tree may control the flow rate and pressure of production from the reservoir 102 by way of the wellbore 120, and route the production to a distribution network, such as tanks, pipelines, and transport vehicles that supply the production to refineries, export terminals, and so forth. If the reservoir pressure is not high enough to cause hydrocarbons to flow from the reservoir 102 to the earth's surface 108 by way of the wellbore 120 at a suitable rate, installing surface production components may include installing a lifting device (for example, a pumping jack) at the wellhead system 124 to provide artificial lift to draw hydrocarbons from the reservoir 102 by way of the wellbore 120. In some embodiments, a lifting device is provided in combination with a production tree.

In some embodiments, conducting production operations (block 708) includes producing hydrocarbons from the horizontally-oriented well. For example, conducting production operations may include the control system 134 operating one or both of an installed production tree and lifting device to provide for controlled extraction of the hydrocarbons from the reservoir by way of the wellbore 120. The produced hydrocarbons may be routed to a production distribution network.

Figure 8:
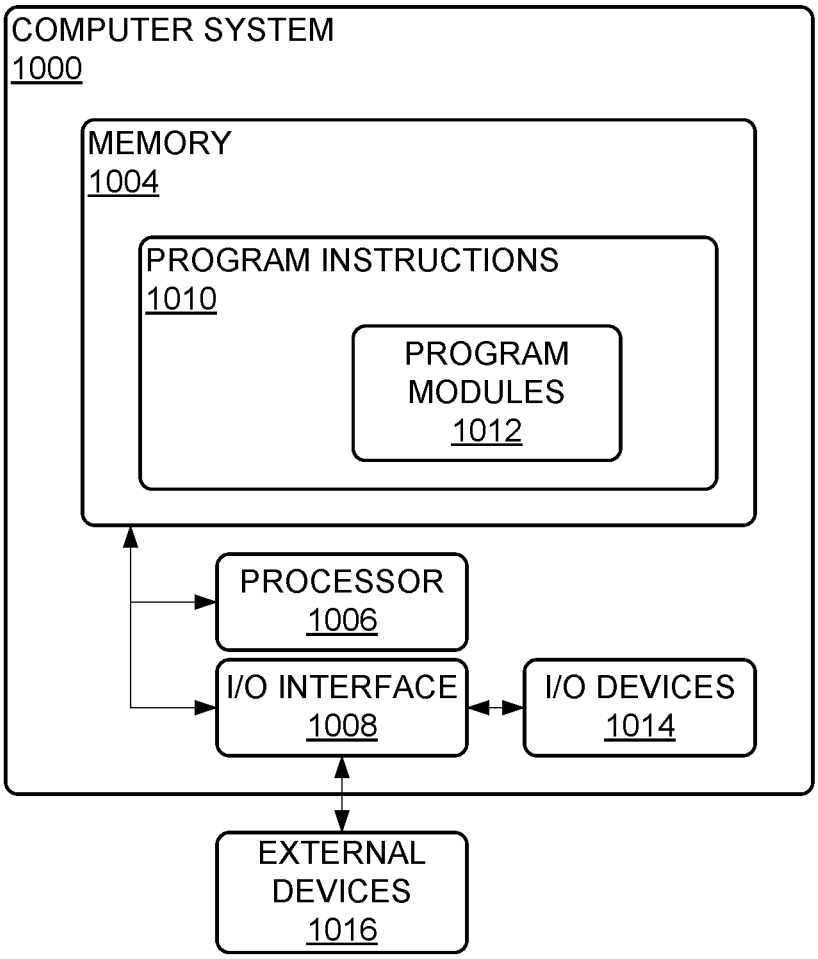
FIG. 8 is a diagram that illustrates an example computer system in accordance with one or more embodiments.

FIG. 8 is a diagram that illustrates an example computer system (or "system") 1000 in accordance with one or more embodiments. In some embodiments, the system 1000 is a programmable logic controller (PLC). The system 1000 may include a memory 1004, a processor 1006 and an input/output (I/O) interface 1008. The memory 1004 may include non-volatile memory (for example, flash memory, read-only memory (ROM), programmable read-only memory (PROM), erasable programmable read-only memory (EPROM), electrically erasable programmable read-only memory (EEPROM)), volatile memory (for example, random access memory (RAM), static random access memory (SRAM), synchronous dynamic RAM (SDRAM)), or bulk storage memory (for example, CD-ROM or DVD-ROM, hard drives). The memory 1004 may include a non-transitory computer-readable storage medium having program instructions 1010 stored in the memory 1004. The program instructions 1010 may include program modules 1012 that are executable by a computer processor (for example, the processor 1006) to cause the functional operations described, such as those described with regard to at least one or both of the control system 134 and the method 700.

The processor 1006 may be any suitable processor capable of executing program instructions. The processor 1006 may include a central processing unit (CPU) that carries out program instructions (for example, the program instructions of the program module(s) 1012) to perform the arithmetical, logical, and input/output operations described. The processor 1006 may include one or more processors. The I/O interface 1008 may provide an interface for communication with one or more I/O devices 1014, such as a joystick, a computer mouse, a keyboard, or a display screen (for example, an electronic display for displaying a graphical user interface (GUI)). The I/O devices 1014 may include one or more of the user input devices. The I/O devices 1014 may be connected to the I/O interface 1008 by way of a wired connection (for example, Industrial Ethernet connection) or a wireless connection (for example, Wi-Fi connection). The I/O interface 1008 may provide an interface for communication with one or more external devices 1016, such as other computers and networks. In some embodiments, the I/O interface 1008 includes one or both of an antenna and a transceiver. In some embodiments, the external devices 1016 include one or more of the motive device 202, the horizontally-oriented drive system 214, and down-hole sensors.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described here are to be taken as examples of embodiments. Elements and materials may be substituted for those illustrated and described here, parts and processes may be reversed or omitted, and certain features of the embodiments may be utilized independently, all as would be apparent to one skilled in the art after having the benefit of this description of the embodiments. Changes may be made in the elements described here without departing from the spirit and scope of the embodiments as described in the following claims. Headings used here are for organizational purposes only and are not meant to be used to limit the scope of the description.

It will be appreciated that the processes and methods described here are example embodiments of processes and methods that may be employed in accordance with the techniques described here. The processes and methods may be modified to facilitate variations of their implementation and use. The order of the processes and methods and the operations provided may be changed, and various elements may be added, reordered, combined, omitted, modified, etc. Portions of the processes and methods may be implemented in software or hardware. Some or all of the portions of the processes and methods may be implemented by one or more of the processors/modules/applications described here.

As used throughout this application, the word "may" is used in a permissive sense (i.e., meaning having the potential to), rather than the mandatory sense (i.e., meaning must). The words "include," "including," and "includes" mean including, but not limited to. As used throughout this application, the singular forms "a", "an," and "the" include plural referents unless the content clearly indicates otherwise. Thus, for example, reference to "an element" may include a combination of two or more elements. As used throughout this application, the term "or" is used in an inclusive sense, unless indicated otherwise. That is, a description of an element including A or B may refer to the element including one or both of A and B. As used throughout this application, the phrase "based on" does not limit the associated operation to being solely based on a particular item. Thus, for example, processing "based on" data A may include processing based at least in part on data A and based at least in part on data B, unless the content clearly indicates otherwise. As used throughout this application, the term "from" does not limit the associated operation to being directly from. Thus, for example, receiving an item "from" an entity may include receiving an item directly from the entity or indirectly from the entity (for example, by way of an intermediary entity). Unless specifically stated otherwise, as apparent from the discussion, it is appreciated that throughout this specification discussions utilizing terms such as "processing," "computing," "calculating," "determining," or the like refer to actions or processes of a specific apparatus, such as a special purpose computer or a similar special purpose electronic processing/computing device. In the context of this specification, a special purpose computer or a similar special purpose electronic processing/computing device is capable of manipulating or transforming signals, typically represented as physical, electronic or magnetic quantities within memories, registers, or other information storage devices, transmission devices, or display devices of the special purpose computer or similar special purpose electronic processing/computing device.

What is claimed is:

1. A hydrocarbon well drilling system comprising:

a wellhead system comprising a wellhead body disposed at a surface of the earth, the wellhead body comprising a wellhead passage configured to guide a drill string from a horizontal orientation to a downward sloping orientation of a wellbore having a sigmoid well trajectory, the wellhead passage extending from a wellhead entrance at a vertically oriented side of the wellhead body to a wellhead exit at a horizontally oriented underside of the wellhead body, wherein the wellhead passage comprises an up-hole portion having a horizontally oriented trajectory, and a down-hole portion having a downward sloping trajectory that terminates at the wellhead exit;

a drill string configured to pass through the wellhead passage, the drill string comprising a horizontally oriented starting end and a drill bit configured to bore through a subsurface formation to create the wellbore having the sigmoid well trajectory, the wellbore comprising:

a first sigmoid portion extending from the wellhead exit to an inflection point of the wellbore, the inflection point being located downhole from the wellhead exit, the first sigmoid portion of the wellbore comprising a first trajectory that is generally horizontal at the wellhead exit of the wellbore and that increases in slope to a first gradient at the inflection point; and a second sigmoid portion extending from the inflection point of the wellbore to a transition point of the wellbore, the transition point being located downhole from the inflection point, the second sigmoid portion of the wellbore comprising a second trajectory that matches the first gradient of the first sigmoid portion of the wellbore at the inflection point and that decreases in slope to a second gradient at the transition point; and a drilling control system, comprising:

a motive system configured to exert a horizontal motive force on the horizontally oriented starting end of the drill string to generate a force to facilitate the drill bit boring through the subsurface formation to create the wellbore having the sigmoid well trajectory.

2. The system of claim 1, wherein the wellhead body is partially disposed below the surface of the earth such that wellhead entrance is disposed above the surface of the earth, and the horizontally oriented underside of the wellhead body is disposed below the surface of the earth.

3. The system of claim 1, wherein the wellhead system comprises a wellhead stabilizer comprising a cage disposed over an upper portion of the wellhead body to inhibit horizontal or vertical movement of the wellhead body.

4. The system of claim 3, wherein the cage comprises extensions that are secured to the surface of the earth.

5. The system of claim 4, wherein the cage comprises one more lateral cage elements that extend laterally across the upper portion of the wellhead body, and one or more longitudinal cage elements that extend longitudinally across the upper portion of the wellhead body.

6. The system of claim 1, wherein the up-hole portion of the wellhead passage comprises a hanger section comprising one or more integrated shoulders for supporting components disposed in the wellbore.

7. The system of claim 6, wherein the down-hole portion of the wellhead passage has a first internal diameter, and wherein the hanger section comprises:

a casing hanger shoulder defined by a casing hanger portion of the up-hole portion of the wellhead passage having a second internal diameter that is greater than the first internal diameter; and a production tubing hanger shoulder defined by a production tubing hanger portion of the up-hole portion of the wellhead passage having a third internal diameter that is greater than the second internal diameter, the production tubing hanger portion being located up-hole from the casing hanger portion.

8. The system of claim 1, wherein the motive system comprises a vehicle configured to advance in a horizontal direction to exert the horizontal motive force on the starting end of the drill string.

9. The system of claim 1, wherein the motive system comprises a ram configured to advance in a horizontal direction to exert the horizontal motive force on the starting end of the drill string.

10. The system of claim 1, wherein the generally horizontal portion of the first trajectory at the wellhead exit comprises an entry angle in the range of 5° to 30° from horizontal.

11. The system of claim 1, wherein the first gradient of the first trajectory at the inflection point of the wellbore comprises an inflection angle in the range of 0° to 45° from vertical.

12. The system of claim 1, wherein the second gradient of the second trajectory at the transition point comprises a transition angle in the range of 0° to 10° from horizontal.

13. The system of claim 1, wherein the wellbore comprises a horizontal portion of the wellbore extending from the transition point of the wellbore, the horizontal portion of the wellbore comprising a third trajectory that matches the third gradient of the second sigmoid portion of the wellbore at the transition point and that has a horizontal gradient along its length.

14. The system of claim 13, wherein the horizontal gradient of the horizontal portion of the wellbore comprises a gradient in the range of 0° to 15° from horizontal.

15. A method of drilling a hydrocarbon well, the method comprising:

installing a wellhead system comprising disposing a wellhead body at a surface of the earth, the wellhead body comprising a wellhead passage configured to guide a drill string from a horizontal orientation to a downward sloping orientation of a wellbore having a sigmoid well trajectory, the wellhead passage extending from a wellhead entrance at a vertically oriented side of the wellhead body to a wellhead exit at a horizontally oriented underside of the wellhead body, wherein the wellhead passage comprises an up-hole portion having a horizontally oriented trajectory, and a down-hole portion having a downward sloping trajectory that terminates at the wellhead exit;

inserting a drill string into the wellhead passage, the drill string comprising a horizontally oriented starting end and a drill bit; and exerting a horizontal motive force on the horizontally oriented starting end of the drill string to generate a force to cause the drill bit to bore through the subsurface formation to create the wellbore having the sigmoid well trajectory, the wellbore comprising:

a first sigmoid portion extending from the wellhead exit to an inflection point of the wellbore, the inflection point being located downhole from the wellhead exit, the first sigmoid portion of the wellbore comprising a first trajectory that is generally horizontal at the wellhead exit of the wellbore and that increases in slope to a first gradient at the inflection point; and a second sigmoid portion extending from the inflection point of the wellbore to a transition point of the wellbore, the transition point being located downhole from the inflection point, the second sigmoid portion of the wellbore comprising a second trajectory that matches the first gradient of the first sigmoid portion of the wellbore at the inflection point and that decreases in slope to a second gradient at the transition point.

16. The method of claim 15, wherein disposing the wellhead body at the surface of the earth comprises disposing a lower portion of the wellhead body below the surface of the earth such that wellhead entrance is disposed above the surface of the earth, and the horizontally oriented underside of the wellhead body is disposed below the surface of the earth.

17. The method of claim 15, wherein installing the wellhead system comprises installing a wellhead stabilizer comprising a cage disposed over an upper portion of the wellhead body to inhibit horizontal or vertical movement of the wellhead body.

18. The method of claim 17, wherein the cage comprises extensions that are secured to the surface of the earth.

19. The method of claim 18, wherein the cage comprises one more lateral cage elements that extend laterally across the upper portion of the wellhead body, and one or more longitudinal cage elements that extend longitudinally across the upper portion of the wellhead body.

20. The method of claim 15, wherein the up-hole portion of the wellhead passage comprises a hanger section comprising one or more integrated shoulders for supporting components disposed in the wellbore.

21. The method of claim 20, wherein the down-hole portion of the wellhead passage has a first internal diameter, and wherein the hanger section comprises:

a casing hanger shoulder defined by a casing hanger portion of the up-hole portion of the wellhead passage having a second internal diameter that is greater than the first internal diameter; and a production tubing hanger shoulder defined by a production tubing hanger portion of the up-hole portion of the wellhead passage having a third internal diameter that is greater than the second internal diameter, wherein the production tubing hanger portion is located up-hole from the casing hanger portion.

22. The method of claim 15, wherein exerting a horizontal motive force to the horizontally oriented starting end of the drill string comprises advancing a vehicle in a horizontal direction to exert the horizontal motive force on the starting end of the drill string.

23. The method of claim 15, wherein exerting a horizontal motive force to the horizontally oriented starting end of the drill string comprises advancing a ram in a horizontal direction to exert the horizontal motive force on the starting end of the drill string.

24. The method of claim 15, wherein the generally horizontal portion of the first trajectory at the wellhead exit comprises an entry angle in the range of 5° to 30° from horizontal.

25. The method of claim 15, wherein the first gradient of the first trajectory at the inflection point of the wellbore comprises an inflection angle in the range of 0° to 45° from vertical.

26. The method of claim 15, wherein the second gradient of the second trajectory at the transition point comprises a transition angle in the range of 0° to 10° from horizontal.

27. The method of claim 15, wherein the wellbore comprises a horizontal portion extending from the transition point of the wellbore, the horizontal portion of the wellbore comprising a third trajectory that matches the third gradient of the second sigmoid portion of the wellbore at the transition point and that has a horizontal gradient along its length.

28. The method of claim 27, wherein the horizontal gradient of the horizontal portion of the wellbore comprises a gradient in the range of 0° to 15° from horizontal.

* * * * *